US010297190B2

(12) United States Patent
Scenini

(10) Patent No.: US 10,297,190 B2
(45) **Date of Patent: *May 21, 2019**

(54) PIXEL SELECTION METHOD FOR A LIGHT-SOURCE MATRIX DRIVER

(71) Applicant: Infineon Technologies AG, Neubiberg (DE)

(72) Inventor: Andrea Scenini, Montegrotto Terme (IT)

(73) Assignee: Infineon Technologies AG, Neubiberg (DE)

( * ) Notice: Subject to any disclaimer, the term of this patent is extended or adjusted under 35 U.S.C. 154(b) by 16 days.

This patent is subject to a terminal disclaimer.

(21) Appl. No.: 15/499,400

(22) Filed: Apr. 27, 2017

(65) Prior Publication Data

US 2018/0308418 A1 Oct. 25, 2018

(30) Foreign Application Priority Data

Apr. 21, 2017 (EP) ..... 17425045

(51) Int. Cl.
*G09G 3/32* (2016.01)
*H05B 33/08* (2006.01)

(52) U.S. Cl.
CPC ..... *G09G 3/32* (2013.01); *H05B 33/0854* (2013.01); *G09G 2300/0404* (2013.01);
(Continued)

(58) Field of Classification Search
CPC ..... G09G 3/32; G09G 2320/0693; G09G 2310/0286; G09G 2310/0237;
(Continued)

(56) References Cited

U.S. PATENT DOCUMENTS 9,781,800 B2 10/2017 Scenini et al.
9,930,748 B1 * 3/2018 Scenini ..... H05B 33/089
(Continued)

FOREIGN PATENT DOCUMENTS

DE 102015218248 A1 3/2016
DE 102016109296 A1 11/2016

OTHER PUBLICATIONS

U.S. Appl. No. 15/499,228, by Andrea Scenini, filed Apr. 27, 2017.
U.S. Appl. No. 15/355,779, filed by Andrea Scenini et al., filed Nov. 18, 2016.
(Continued)

*Primary Examiner* — Amit Chatly
(74) *Attorney, Agent, or Firm* — Shumaker & Sieffert, P.A.

(57) ABSTRACT

In some examples, a device includes at least two light sources, buffer circuitry configured to receive a bit stream, and driver circuitry configured to receive the bit stream from the buffer circuitry and to drive the at least two light sources based on the bit stream. In some examples, the device further includes monitor circuitry configured to determine a voltage drop across each light source of the at least two light sources and snooping circuitry configured to read an inactive bit of the bit stream. In some examples, the snooping circuitry is further configured to read an active bit of the bit stream after reading the inactive bit and based on a value of the inactive bit and to cause the monitor circuitry to determine a voltage drop across a light source of the at least two light sources based on a value of the active bit.

20 Claims, 13 Drawing Sheets

(52) U.S. Cl.
CPC ..... *G09G 2310/0237* (2013.01); *G09G 2310/0286* (2013.01); *G09G 2320/0295* (2013.01); *G09G 2320/041* (2013.01); *G09G 2320/0693* (2013.01); *G09G 2360/18* (2013.01)

(58) Field of Classification Search
CPC ..... G09G 2320/041; G09G 2360/18; G09G 2320/0295; G09G 2300/0404
See application file for complete search history.

(56) References Cited

U.S. PATENT DOCUMENTS

| | | | | |
|---|---|---|---|---|
| 2004/0254756 | A1 | 12/2004 | Strittmatter | |
| 2006/0238723 | A1* | 10/2006 | El-Ghoroury ..... | H04N 9/3147 353/94 |
| 2007/0035538 | A1* | 2/2007 | Garcia ..... | H05B 33/0851 345/212 |
| 2007/0091036 | A1* | 4/2007 | Han ..... | G09G 3/342 345/82 |
| 2014/0375226 | A1 | 12/2014 | Han et al. | |
| 2016/0345392 | A1 | 11/2016 | Scenini et al. | |
| 2016/0345397 | A1 | 11/2016 | De Cicco et al. | |

OTHER PUBLICATIONS

U.S. Appl. No. 15/260,055, filed by Maurizio Galvano et al., filed Sep. 8, 2016.
Extended European Search Report from counterpart European Patent Application No. 17425045.6, dated Oct. 19, 2017, 8 pp.

* cited by examiner

PIXEL SELECTION METHOD FOR A LIGHT-SOURCE MATRIX DRIVER

TECHNICAL FIELD

This disclosure relates to circuitry for driving light sources such as light emitting devices.

BACKGROUND

Driver circuitry may operate, or drive, one or more light sources, such as light emitting diodes (LEDs). The driver circuitry may control a light intensity output by a light source by varying an average amount of electrical current flowing through the light source. For example, the driver circuitry may increase a duty cycle of an electrical current delivered to a light source to increase a light intensity generated by the light source. Similarly, the driver circuit may decrease the duty cycle of the electrical current delivered to a light source to decrease the light intensity generated by the light source. At high switching frequencies, a human eye may perceive a change in the duty cycle of the electrical current as a change in the brightness or intensity of the light generated by the light source.

SUMMARY

This disclosure describes a device including at least two light sources and monitor circuitry configured to determine a voltage drop across each light source. The monitor circuitry may be configured to determine the voltage drop for a specific light source when the specific light source is on or off, i.e., generating or not generating light based on an electrical current passing through the specific light source. The device may receive a bit stream and may include driver circuitry configured to drive the light sources based on the bit values in each frame of the bit stream.

To determine whether a specific light source will be generating light during the next frame of the bit stream, the device includes snooping circuitry that may be configured to read a specific bit from the incoming frame of the bit stream. The specific bit may indicate whether the specific light source will be generating light during the next frame. In some examples, the snooping circuitry may be configured to look for an active bit in the incoming frame so that the monitor circuitry determines the voltage drop across a light source only if the light source is on. Additionally or alternatively, the monitor circuitry may be configured to determine the voltage drop across a current source in the driver circuitry or whether there is a short circuit or open circuit across the specific light source.

In some examples, a device includes at least two light sources, buffer circuitry configured to receive a bit stream, and driver circuitry configured to receive the bit stream from the buffer circuitry and to drive the at least two light sources based on the bit stream. In some examples, the device further includes monitor circuitry configured to determine a voltage drop across each light source of the at least two light sources and snooping circuitry configured to read an inactive bit of the bit stream. In some examples, the snooping circuitry is further configured to read an active bit of the bit stream after reading the inactive bit and based on a value of the inactive bit and to cause the monitor circuitry to determine a voltage drop across a light source of the at least two light sources based on a value of the active bit.

In some examples, a method includes receiving a bit stream, reading an inactive bit of the bit stream, and reading an active bit of the bit stream, after reading the inactive bit and based on a value of the inactive bit. The method further includes driving at least two light sources based on the bit stream and determining a voltage drop across a light source of the at least two light sources based on a value of the active bit.

In some examples, a device includes at least two light sources, buffer circuitry configured to receive a bit stream, and driver circuitry configured to receive the bit stream from the buffer circuitry and to drive the at least two light sources based on the bit stream. In some examples, the device further includes monitor circuitry configured to determine a voltage drop across each light source of the at least two light sources and snooping circuitry configured to read an inactive bit of the bit stream. In some examples, the snooping circuitry is further configured to read an active bit of the bit stream after reading the inactive bit and based on a value of the inactive bit and to cause the monitor circuitry to determine a voltage drop across a light source of the at least two light sources based on a value of the active bit. The device includes controller circuitry configured to determine whether the voltage drop across the light source is within an acceptable voltage window and to cause the driver circuitry to increase or decrease the voltage drop across the light source in response to determining whether the voltage drop across the light source is not within the acceptable voltage window.

The details of one or more examples are set forth in the accompanying drawings and the description below. Other features, objects, and advantages will be apparent from the description and drawings, and from the claims.

DETAILED DESCRIPTION

Figure 1:
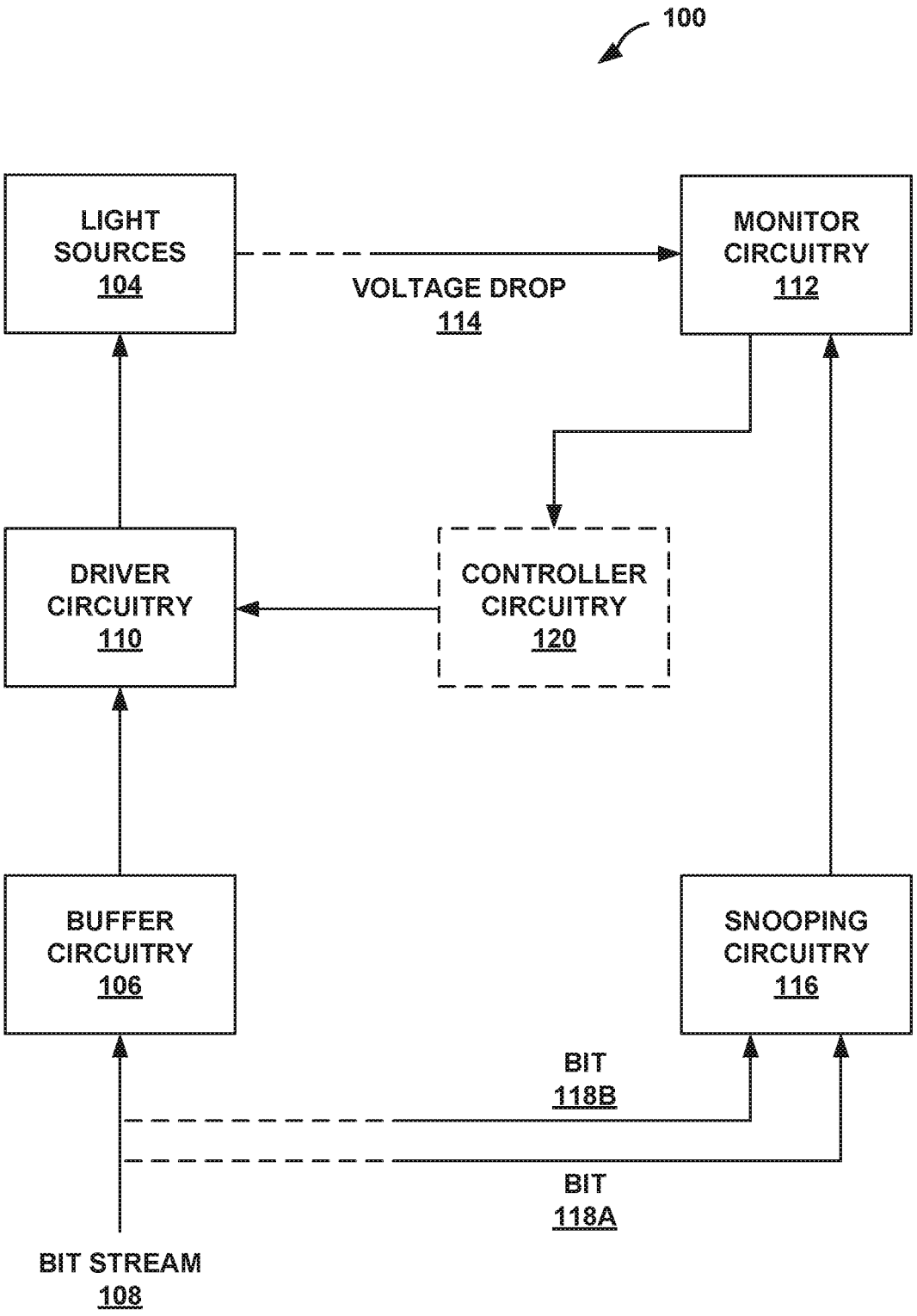
FIG. 1 is a conceptual block diagram of a device including at least two light sources, in accordance with some examples of this disclosure.

A device may include at least two light sources and driver circuitry configured to selectively drive each light source of the at least two light sources. The driver circuitry may be configured to drive the light sources based on the bit values in each frame of a bit stream received by the device. The device may also include monitor circuitry configured to determine the voltage drop across each of the light sources. In some examples, the voltage drop across a specific light source may indicate whether the specific light source is functioning properly and/or whether the temperature of the specific light source is higher than a desirable operating temperature. Additionally or alternatively, the monitor circuitry may be configured to determine the voltage drop across a current source in the driver circuitry. The monitor circuitry may also be configured to determine whether there is a short circuit or open circuit across the specific light source.

To determine the voltage drop across a light source, the device may include snooping circuitry configured to read one or more bits in a first frame of the bit stream as buffer circuitry of the device receives the first frame. A specific bit in the first frame that is received by the buffer circuitry may indicate whether the driver circuitry will drive a specific light source during a second frame. In some examples, the second frame may immediately follow the first frame. By reading the specific bit as the buffer circuitry receives the first frame, the snooping circuitry may cause the monitor circuitry to determine a voltage drop across the specific light source during the second frame.

The snooping circuitry may be configured to read a first bit in a first frame of the bit stream before the driver circuitry uses the first frame to drive the specific light source. If the first bit is an inactive bit (i.e., a bit with an inactive value), the snooping circuitry may be configured to read a second bit in the first frame. The second bit may have a position in the first frame that is later than a position of the first bit. In some examples, the second bit may immediately follow the first bit in the first frame. If the second bit is an active bit (i.e., a bit with an active value), the snooping circuitry may be configured to cause the monitor circuitry to determine the voltage drop across a respective light source. If the second bit is an inactive bit, the snooping circuitry may be configured to continue reading successive bits until snooping circuitry finds an active bit or reaches the end of the frame.

By skipping inactive bits, the monitor circuitry may be capable of monitoring a larger number of light sources in a given number of frames, as compared to another device. Snooping circuitry and monitor circuitry of this disclosure may be capable of monitoring a bit stream in a shorter amount of frame or time. Thus, snooping circuitry of this disclosure may make the monitor circuitry more efficient by selecting an active bit and causing the monitor circuitry to monitor a respective light source. The snooping circuitry may increase the efficiency and/or productivity of the monitor circuitry by finding an active bit in almost every frame.

FIG. 1 is a conceptual block diagram of a device 100 including at least two light sources 104, in accordance with some examples of this disclosure. Device 100 may include light sources 104, buffer circuitry 106, driver circuitry 110, monitor circuitry 112, snooping circuitry 116, and optional controller circuitry 120. In some examples, device 100 may be a lighting device for a vehicle, a building, and/or any other system that includes a lighting device.

Light sources 104 may include two or more light sources such as light-emitting diodes (LEDs) or any other suitable light sources. Light sources 104 may be arrayed in a matrix or grid formation, and each light source may be a pixel. In some examples, light sources 104 may include one thousand and twenty-four light sources that are arrayed in a grid of thirty-two light sources by thirty-two light sources. Each of light sources 104 may be numbered in sequential order. For a first frame of bit stream 108, some of light sources 104 may be on, and some of light sources 104 may be off. From the first frame to a second frame of bit stream 108, some of light sources 104 that were on in the first frame may remain on for the second frame, and some of light sources 104 that were on in the first frame may switch off for the second frame.

Buffer circuitry 106 may be configured to receive bit stream 108, which may include a series of bits. Each bit of bit stream 108 may correspond to a light source of light sources 104. In some examples, buffer circuitry 106 may include a shift register with a number of bits that may be equal or approximately equal to the number of light sources in light source 104. As a shift register, buffer circuitry 106 may include a cascade of flip flops sharing the same clock input. When buffer circuitry 106 has finished receiving a first frame of bit stream 108, buffer circuitry 106 may deliver bit stream 108 to driver circuitry 110 and begin receiving a second frame of bit stream 108. Each frame of bit stream 108 may include a number of bits that is equal to or approximately equal to the number of light sources in light sources 104.

In some examples, buffer circuitry 106 may be configured to deliver a first frame of bit stream 108 to driver circuitry 110 in response to receiving an update signal. In some examples, the update signal may include a pulse or high digital value to indicate the end of each frame of bit stream 108. As used herein, the terms "receiving an update signal" and "delivering an update signal" may mean receiving or delivering the high pulse of the update signal. The high pulse of the update signal may indicate that buffer circuitry 106 has received bit stream 108. Device 100 may also include error-checking circuitry configured to determine whether each frame includes errors. If the error-checking circuitry determines that the first frame includes an error, device 100 may not deliver an update signal to cause buffer circuitry 106 to deliver the first frame of bit stream 108 to driver circuitry 110. If the error-checking circuitry does not determine that a frame includes an error, device 100 may be configured to generate and deliver the update signal to the circuits of FIG. 1. In response to receiving a high pulse of the update signal, buffer circuitry 106 may be configured to deliver a frame of bit stream 108 to driver circuitry 110.

Bit stream 108 may include one or more frames, where each frame of bit stream 108 may include one or more bits such as bits 118A and 118B. Bit stream 108 may include a series of frames, where each frame includes a series of digital bits. Each bit of bit stream 108 may be a command signal to driver circuitry 110 for a light source of light sources 104. Driver circuitry 110 may be configured to transmit each bit to a current source for the respective light source of light sources 104. Each bit may command the respective current source to deliver electrical current to the respective light source of light sources 104.

Driver circuitry 110 may be configured to receive bit stream 108 from buffer circuitry 106. Driver circuitry 110 may also be configured to drive light sources 104 based on the bits in bit stream 108. For example, driver circuitry 110 may be configured to drive a first light source based on a first bit and to drive a second light source based on a second bit. In some examples, a high bit such as a "1" in a frame may cause driver circuitry 110 to drive the corresponding light source during the frame, and a low bit such as a "0" may cause driver circuitry 110 to refrain from driving the corresponding light source. In some examples, driver circuitry 110 may be configured to refrain from driving a first light source based on the value of bit 118A and to drive a second light source based on the value of bit 118B.

If the frame rate for device 100 is one frame per five microseconds (i.e., two hundred kilohertz), each frame of bit stream 108 may cause driver circuitry 110 to drive, or refrain from driving, light sources 104 for five microseconds. To brighten or dim a light source of light sources 104, processing circuitry may increase or decrease the percentage of high bits in the frames of bit stream 108. At one frame per five microseconds, driver circuitry 110 may drive a specific light source based on two hundred thousand frames of a specific bit during a one-second time period. The apparent brightness of the specific light source to a human eye may be based on the percentage of frames in which the specific bit that corresponds to the specific light source has a high value.

Monitor circuitry 112 may be configured to determine the voltage drop across one or more of light sources 104. In some examples, monitor circuitry 112 may also be configured to determine the voltage drop across a current source of driver circuitry 110 that is configured to drive a one of light sources 104. In some examples, monitor circuitry 112 may be configured to determine an open circuit or a short circuit across a current source or across a light source.

Monitor circuitry 112 may be configured to determine the voltage drop across each light source of light sources 104 by using one or more multiplexers. The multiplexers may allow monitor circuitry 112 to measure the voltage drop across one or more of the light sources during each frame of bit stream 108. In some examples, monitor circuitry 112 may include one or more levels of multiplexers. The first level of multiplexers may include a number of inputs that is equal to the number of light sources 104. Monitor circuitry 112 may include an analog-to-digital converter (ADC) configured to receive an analog output signal of the last level of multiplexers, which may indicate the voltage drop across a light source. The ADC may be configured to convert the analog output signal to a digital signal. The digital signal may indicate the approximate amplitude of the voltage drop across a light source of light sources 104.

In some examples, monitor circuitry 112 may be configured to determine the voltage drop across a first light source during a first frame, determine the voltage drop across a second light source during a second frame, and so on. In some examples, monitor circuitry 112 may be capable of determining the voltage drop across only one light source during each frame. In other examples, monitor circuitry 112 may be capable of determining the voltage drop across more than one light source during each frame.

In accordance with the techniques of this disclosure, snooping circuitry 116 may be configured to read bit 118A as buffer circuitry 106 receives bit stream 108. Bit 118A may be an inactive bit, meaning that the value of bit 118A is inactive value. If bit 118A is an inactive bit, driver circuitry 110 may be configured to refrain from driving a respective light source when driver circuitry 110 receives bit 118A. Snooping circuitry 116 may be further configured to read bit 118B after reading bit 118A and based on the inactive value of bit 118A. Snooping circuitry 116 may be further configured to cause monitor circuitry 112 to determine voltage drop 114 across the light source associated with bit 118B based on the active value of bit 811B.

For example, the value of bit 118A may be an inactive value such as "0". In response to determining that the bit 118A has an inactive value, snooping circuitry 116 may be configured to read bit 118B, which may be the next bit in the frame of bit stream 108 that buffer circuitry 106 is receiving. If the next bit has an inactive value, snooping circuitry 116 may be configured to continue reading bits until snooping circuitry 116 reads a bit with an active value, such as "1". For example, snooping circuitry 116 may be configured to read a second inactive bit after reading bit 118A and based on the value of bit 118A and to read bit 118B after reading the second inactive bit and based on the value of the second inactive bit.

When driver circuitry 110 receives bit 118A for a first respective light source, and bit 118A has an inactive value, driver circuitry 110 may be configured to refrain from driving the first respective light source during the next frame. When driver circuitry 110 receives bit 118B for a second respective light source, and bit 118B has an active value, driver circuitry 110 may be configured to drive the second respective light source during the next frame. Thus, by skipping inactive bits, snooping circuitry 116 may be configured to choose an active bit and to cause monitor circuitry 112 to determine a voltage drop across a light source that is active during the next frame.

After reading bit 118B, snooping circuitry 116 may be configured to cause monitor circuitry 112 to determine voltage drop 114 in response to receiving an update signal, such as in response to receiving a high pulse of the update signal. Snooping circuitry 116 may be configured to read bits 118A and 118B before receiving the pulse of the update signal. After snooping circuitry 116 receives the update signal indicating the end of the first frame, snooping circuitry 116 may be configured to read a bit from the next frame.

Snooping circuitry 116 may be configured to determine a position of bits 118A and 118B in bit stream 108 based on a position of the respective light sources of light sources 104. In some examples, the respective light sources may be positioned in a matrix (i.e., grid) of light sources 104. Snooping circuitry 116 may be configured to determine the position of bits 118A and 118B in bit stream 108 by at least accessing a lookup table associating positions of bits in bit stream 108 and positions of light sources 104 in the matrix.

In some examples, snooping circuitry 116 may include counter circuitry that is configured to count the position of bit 118A as buffer circuitry 106 receives bit stream 108. For example, snooping circuitry 116 may determine that bit 118A is located in a specific position with bit stream 108, such as a sixth position. As buffer circuitry 106 receives a frame of bit stream 108, the counter circuitry may count to the specific position. In some examples, the counter circuitry may be configured to increment a count (i.e., counter value) until the count is equal to the number of the specific position. The counter circuitry may be configured to determine whether the count is a specific value (i.e., the number of the specific position). The counter circuitry may then be configured to cause snooping circuitry 116 to read bit 118A in response to counting the position of bit 118A. The counter circuitry may be further configured to continue to increment the count in response to determining that the counter value is not the specific value.

In some examples, there may be one or more inactive bits between bits 118A and 118B in bit stream 108. Snooping circuitry 116 may be configured to read the inactive bits in order until snooping circuitry 116 reads an active bit, such as bit 118B. Snooping circuitry 116 may be further configured to cause the counter circuitry to increment a counter value in response to each determination that the value of a bit is not the active value.

In some examples, snooping circuitry 116 may be configured to determine that the value of bit 118A is not an active value and to cause the counter circuitry to increment the count in response to determining that the value of bit 118A is not the active value. By incrementing the count, snooping circuitry 116 may keep track of the position of the next bit, which may be bit 118B. Snooping circuitry 116 may be configured to determine that a value of bit 118B is an active value and store the counter value in response to determining that the value of bit 118B is an active value.

In some examples, the counter circuitry may be further configured to clear the counter value in response to receiving an update signal. The counter circuitry may be configured to increment the counter value in response to receiving each bit of the second frame until the counter value is the stored counter value. The second frame may immediately follow the first frame, where the first frame included bits 118A and 118B. In some examples, the stored counter value may be the position of bit 118B in the first frame plus one so that counter circuitry counts to the bit immediately following bit 118B. The counter circuitry may be configured to determine whether the counter value is the stored counter value and cause snooping circuitry 116 to read a first bit of the second frame in response to determining that the counter value is the stored counter value. As explained above, a position of the first bit in the second frame may be later than, such as immediately after, the positions of bits 118A and 118B. The counter circuitry may be configured to continue to increment the counter value in response to determining that the counter value is not the specific value as the counter circuitry counts through the second frame of bit stream 108.

Snooping circuitry 116 and/or monitor circuitry 112 may be configured to determine whether the respective light sources are on or will be on before monitor circuitry 112 determines a voltage drop across one or more of the respective light sources. In some examples, monitor circuitry 112 may be configured to determine the voltage drop across a light source if and only if the light source is or will be on during the voltage measurement. In other examples, monitor circuitry 112 may be configured to determine the voltage drop across the light source regardless of whether the light source is or will be on during the voltage measurement. The capability of snooping circuitry 116 to read bit 118B in a frame of bit stream 108 as the frame is received by buffer circuitry 106 may allow device 100 to synchronize the determination of voltage drop 114 across a respective light source. The determination may be synchronized by selecting a respective light source that will be on during the measurement, by selecting a respective light source that will be off during the measurement, and/or by selecting a respective light source based on the value of bit 118B.

In some examples, snooping circuitry 116 may be further configured to determine whether a value of the first bit of the second frame is an active value and to cause the monitor circuitry to determine a voltage drop across a respective light source of light sources 104 in response to determining that the value of the first bit of the second frame is the active value. Snooping circuitry 116 may be configured to store the counter value in response to determining that the value of the first bit of the second frame is the active value and cause the counter circuitry to increment the counter value in response to determining that the value of the first bit of the second frame is not the active value. If snooping circuitry 116 determines that the value of the first bit of the second frame is not the active value, snooping circuitry 116 may be configured to read a second bit of the second frame in response to determining.

Controller circuitry 120 may be configured to determine whether voltage drop 114 is within an acceptable voltage window. The acceptable voltage window may include an upper threshold that is less than an open-circuit voltage and a lower threshold that is more than a short-circuit voltage. The thresholds of the acceptable voltage window may be established based on acceptable operating temperatures, such that determining voltage drop 114 outside of the acceptable voltage window may indicate an unacceptable temperature. Controller circuitry 120 may be configured to cause driver circuitry 110 to increase or decrease voltage drop 114 across the specific light source in response to determining that voltage drop 114 across the light source is not within the acceptable voltage window.

In accordance with the techniques of this disclosure, snooping circuitry 116 may be configured to read bits 118A and 118B as buffer circuitry 106 receives a first frame of bit stream 108. Snooping circuitry 116 may be configured to determine the value of bit 118A and read bit 118B in response to determining that the bit 118A has an inactive value. Snooping circuitry 116 may be configured to read bits 118A and 118B as buffer circuitry 106 receives the first frame of bit stream 108, so that monitor circuitry 112 can determine voltage drop 114 as driver circuitry 110 is driving light sources 104 based on the first frame of bit stream 108. In contrast, another device may read one bit per frame and/or wait for a light source to reach an active state before beginning the monitoring process.

For example, snooping circuitry 116 may read bits 118A and 118B of a first frame of bit stream 108. When buffer circuitry 106 receives an update signal, buffer circuitry 106 may deliver the first frame to driver circuitry 110 and begin receiving a second frame of bit stream 108. Driver circuitry 110 may be configured to drive light sources 104 based on the first frame of bit stream 108. While driver circuitry 110 is driving light sources 104 based on the first frame, snooping circuitry 116 may be configured to cause monitor circuitry 112 to determine voltage drop 114 across a light source that corresponds to bit 118B. By reading both of bits 118A and 118B as buffer circuitry 106 receives the first frame, snooping circuitry 116 may prepare monitor circuitry to determine voltage drop 114 as driver circuitry 110 drives light sources 104 based on the first frame. In some examples, snooping circuitry 116 may be configured to compare the value of each of bits 118A and 118B to a requested state and cause monitor circuitry 112 to determine the voltage drop based on the comparison of the value of both of bits 118A and 118B to the requested state.

Device 100 may be configured to run a diagnosis of the current sources of a light source matrix driver integrated circuit (IC). The algorithm to loop through the matrix may be based on a round-robin approach, such that snooping circuitry 116 may be configured to check the current sources by reading bits in sequence. In some examples, device 100 may be configured to check the current sources for the light sources in an active state. Snooping circuitry 116 may be configured to check the incoming data stream and extract the first '1' in the stream after the position of the last light source that snooping circuitry 116 checked. In some examples, this approach may avoid losing time waiting for the next frame or for a specific light source to turn on. At every new frame, snooping circuitry 116 may be configured to select a new light source that is in an active state by skipping light sources that are in inactive states instead. Using this method, snooping circuitry 116 may lose a frame only upon reaching the last position in bit stream 108 because the frame may end and bit stream 108 may roll back to the beginning of bit stream 108.

For example, a matrix may include two hundred and fifty-six current sources. Snooping circuitry 116 may be configured to check whether the first pixel is on by reading the first bit of a first frame of bit stream 108. If the first bit has an active value, meaning that the first pixel will be on in the next frame, snooping circuitry 116 may be configured to select and possibly store the first bit. Snooping circuitry 116 may be configured to cause monitor circuitry 112 to check the first pixel during the next frame. Buffer circuitry 106 may then receive the next frame where the second and third pixel are off (i.e., the second and third bits have inactive values), while the fourth pixel may have an active value. As a result, the logic circuitry of snooping circuitry 116 may be configured to skip the switched off bits (the second and third bits) and run a diagnosis on the fourth pixel because the fourth bit has an active value in the second frame.

The algorithm may continue until the last position (i.e., 256). Once this is served, the algorithm may start again from position one looking for first '1' (i.e., active bit). Any device 100 may also be configured to account for transmission errors because the light source coordinates are not updated without an update signal. A main advantage of device 100 may be that the matrix is traversed in a shorter time than in other devices because switched off pixels (i.e., inactive bits) may be skipped and monitor circuitry 112 may not wait, or be less likely to wait, for a selected pixel to switch on. The implementation may include a small number of gates to be implemented and therefore may have an advantage in the terms of area, as compared to other devices. Additionally, light sources 104 may not need wires in the matrix area, and there may be a low impact on matrix routability.

Figure 2:
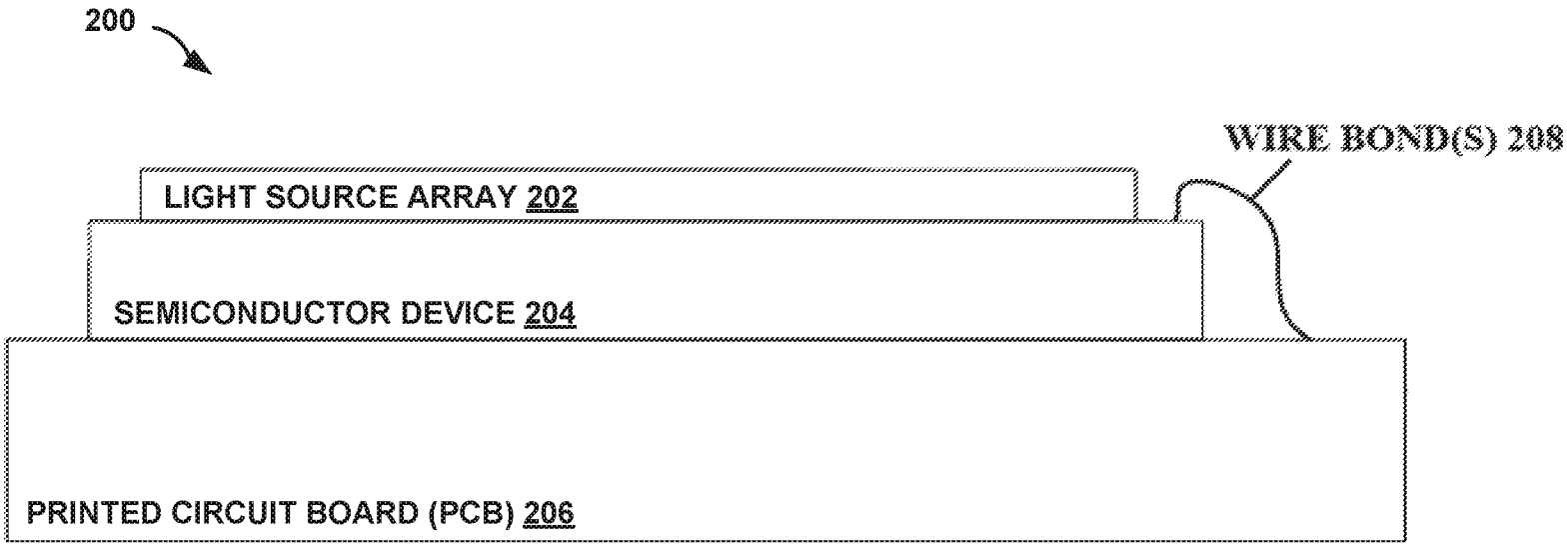
FIG. 2 shows an exemplary arrangement comprising a light emitting diode (LED) array which is placed on top of a semiconductor device, in accordance with some examples of this disclosure.

FIG. 2 shows an exemplary arrangement comprising a light source array 202 which is placed on top of a semiconductor device 204, in accordance with some examples of this disclosure. Device 200 may include light source array 202, semiconductor device 204, printed circuit board (PCB) 206, and wire bond(s) 208. Light source array 202 and semiconductor device 204 may be a chip-on-chip assembly. Light source array 202 may include at least two light sources. Semiconductor device 204 may be arranged on PCB 206. Semiconductor device 204 may be electronically connected to PCB 206 via bond wires 208.

Semiconductor device 204 may comprise at least one of the following: current sources for individual light sources arranged on light source array 202, in particular at least one current source for each light source; a communication interface for driving the light sources and for management purposes; generation of at least one reference current; and diagnosis and protection functionality. For such purposes, semiconductor device 204 may comprise an array of silicon cells, wherein each silicon cell (also referred to as pixel cell) may comprise a current source, which may be directly connected to a light source of light source array 202. In addition, semiconductor device 204 may comprise current source regulation circuitry or any other circuitry as discussed throughout.

In some examples, the at least one current source of semiconductor device 204 may be a part of driver circuitry configured to drive light source array 202 based on a bit stream. The communication interface of semiconductor device 204 may be a part of buffer circuitry configured to receive the bit stream and deliver the bit stream to the driver circuitry. Semiconductor device 204 may be configured to receive a bit stream through bond wire(s) 208 and an electrical connection in PCB 206. In some examples, semiconductor device may include 1,024 current sources, each directly connected to a LED of light source array 202. Semiconductor device 204 may independently control the current sources in order to generate the correct light pattern either in beam shape and intensity.

In some examples, device 200 may be a high-pixel LED driver, where light source array 202 may be an LED array of 1,024 pixels that is mounted on top of a silicon substrate array (i.e., semiconductor device 204) in a chip-on-chip assembly solution. In some examples, semiconductor device 204 may be an intelligent, smart silicon-substrate chip. The smart silicon substrate may include an array of pixel cells called an LED driver matrix and may be placed and directly connected to each respective LED of light source array 202. Each pixel cell of light source array 202 may include an area of 125 μm by 125 μm. The smart silicon substrate may also include common circuitry outside the LED matrix area, where the common circuitry may include, for example, the communication interfaces or diagnosis and protection circuitry. The common circuitry may add to the total volume of device 200, and it may be desirable to have a smaller volume for device 200.

Figure 3:
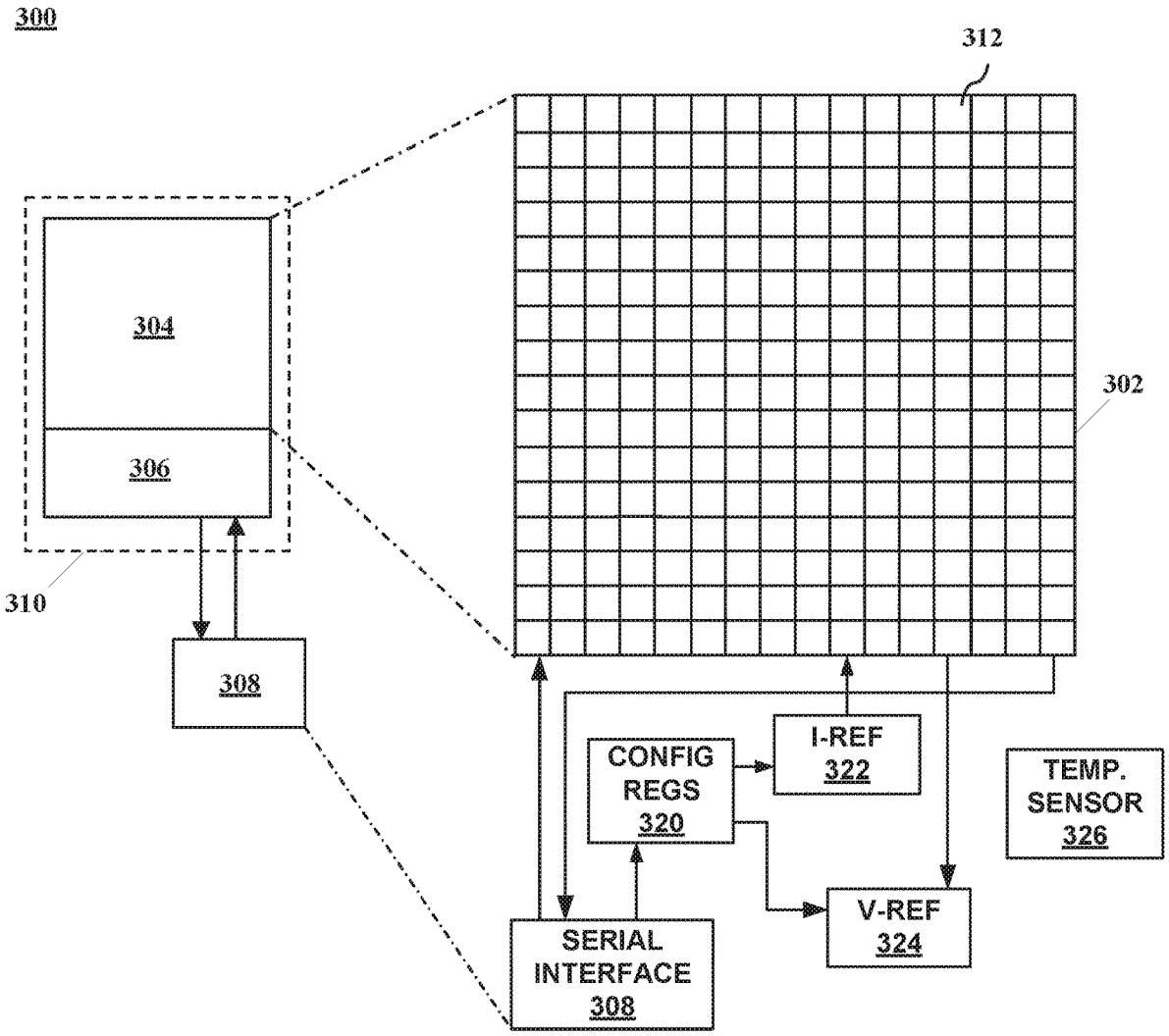
FIG. 3 shows an exemplary block diagram of a matrix of light sources and a semiconductor device comprising driver circuitry, in accordance with some examples of this disclosure.

FIG. 3 shows an exemplary block diagram of a matrix 302 of light sources 312 and a semiconductor device 310 comprising driver circuitry 304, in accordance with some examples of this disclosure. Each pixel of matrix 302 may be represented by at least one light source 312. Driver circuitry 304 may be a portion of semiconductor device 310 that is associated with each one pixel of light source array 202). Semiconductor device 310 may also include circuitry 306. Semiconductor device 310 may be connected to a serial interface 308. Respective light sources 312 of matrix 302 may be controlled via serial interface 308. Matrix 302 may be arranged on top of driver circuitry 304. Driver circuitry 304 may be part of the semiconductor device 204 as shown in FIG. 2 and may comprise a pixel cell area (also referred to as "pixel cell") for each light source 312 of matrix 302. It is an option that driver circuitry 304 has (e.g., substantially) the same area size as matrix 302. In particular, the pixel cell area of driver circuitry 304 may have the same surface area as an individual one light source 312. Light sources 312 of matrix 302 may be directly connected to the pixel cells of driver circuitry 304. Matrix 302 may in particular be arranged on top of driver circuitry 304.

Circuitry 306 may comprise a serial interface for accessing light sources 312 of matrix 302, e.g., one register 320 for configuration purposes, reference current generator 322, reference voltage generator 324 and temperature sensor 326, and may be arranged in an area adjacent or distant to driver circuitry 304. In some examples, circuitry 306 may also include buffer circuitry configured to receive a bit stream and to deliver the bit stream to driver circuitry 304. Matrix 302 may comprise an arbitrary number of light sources (e.g., pixels) arranged in columns and rows. For example, matrix 302 may comprise 256 light sources, 1,028 light sources, 2,056 light sources, etc. In the example shown in FIG. 3, matrix 302 comprises sixteen rows and sixteen columns of light sources 312, amounting to two hundred and fifty-six light sources. An LED may be one example of a light source. It may be an option to use any kind of light source, in particular semiconductor light source. It is another option that each light source may be a component comprising at least two semiconductor light sources.

In an exemplary application, each pixel of matrix 302 may occupy a surface area of, for example, less than 150 μm by 150 μm although surface area occupation may be implementation-specific. Any area suitable for a predetermined resolution of light source array 202 may be selected. The semiconductor light source may be arranged in the middle of each pixel cell. Adjacent pixel cells may have a gap between light sources amounting to less than 150 μm. Each light source may have one contact connected to driver circuitry 304 and one contact connected to a common contact, e.g., GND. This is an exemplary scenario; other dimensions, distances and connections may apply accordingly.

With each light source being mounted directly on top of the semiconductor device, each current source is placed in an area defined by the surface area of the pixel cell. In the example provided above, the area amounts to 150 μm·150 μm=0.022500 $mm^2$. For increasing the resolution in x- and y-dimensions (e.g., 0.5°) of the light at long distance and for avoiding extra mechanical components for beam leveling adjustment, a short pitch between the pixel cells is beneficial. In the example provided above, the pitch between pixel cells may be less than 150 μm.

Due to the compact arrangement, a high amount of heat sources may generate different temperatures, which may influence temperature gradients and hence lead to a mismatch between pixels. In addition, the output of each current source per pixel cell may not be directly accessible as the driver circuitry is directly connected to the light sources. Hence, a solution is required that provides at least one of the following: a current source that provides current to the individual light source, which allows switching the light source on or off with high accuracy, optionally providing over-current protection; a diagnostic functionality capable of detecting an open-load and a short to ground of the output channel; a low mismatch between different pixels, i.e., between different current sources; current source regulation circuitry as discussed throughout; etc.

An external device may independently control the state of the pixels of matrix 302 by transmitting a bit stream via serial interface 308. Circuitry 306 may be configured to store the incoming bit stream data in a memory buffer in order to check its integrity. Circuitry 306 may be configured to deliver the bit stream to driver circuitry 304 only if the integrity check is successful. Device 300 may be configured to run an automatic diagnosis of matrix 302, in particular how to run a current source diagnosis to diagnose issues such as short to ground or the voltage drop across a current source, while navigating efficiently through the matrix. Current source outputs may not accessible because they are covered by the light source array. To cope with this limitation, the output net may be observable to the common circuitry part via a group of analog multiplexers that are configured by the system. Circuitry 304 and/or 306 may then convert this voltage by an analog to digital data converter for further processing.

Successive frames of the bit stream may form a pulse-width modulated (PWM) signal to modulate the light sources. Additionally or alternatively, the bit stream may also form a pulse-density modulated (PDM) signal and/or a pulse-frequency modulated (PFM) signal. In some examples, circuitry 306 may indicate a desired state such that the conversion should be executed when the LED is in the desired state. For example, when the desired state is on, the state of a specific light source should stay stable during the conversion. The PWM generator may not be integrated in device 300 but is calculated externally by a microcontroller or by a field-programmable gate array (FPGA) and then transferred to the light source array. In some examples, it may be desirable to run, in the most time efficient way, the diagnosis of the current sources in the matrix when they are in an on state (i.e., an active state), considering also possible communication errors.

Figure 4A:
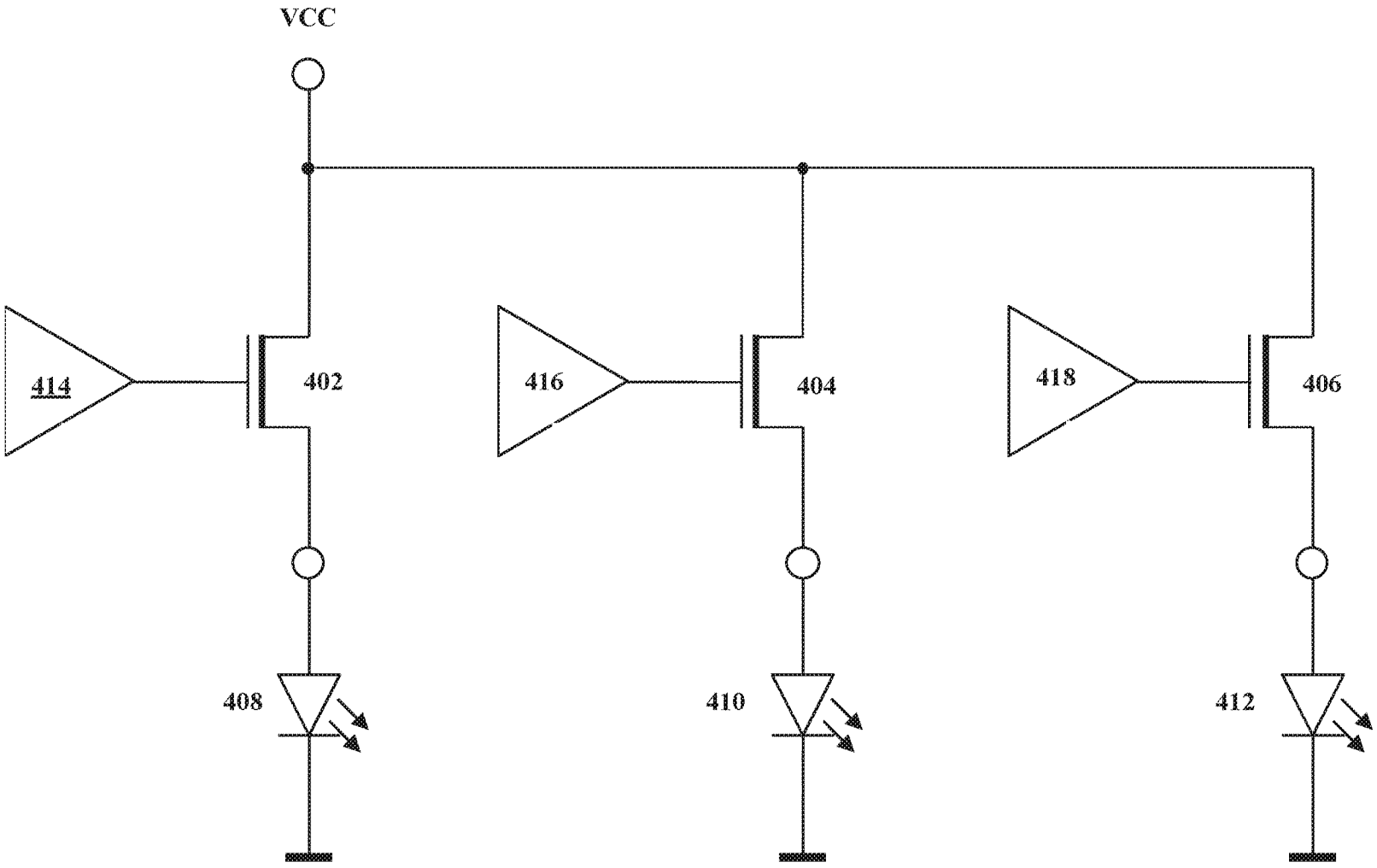
FIG. 4A shows exemplary driver circuitry including high-side current sources, in accordance with some examples of this disclosure.

FIG. 4A shows exemplary driver circuitry including high-side current sources 402, 404, and 406, in accordance with some examples of this disclosure. Each of current sources 402, 404, and 406, each of which being arranged on driver circuitry 304 on top of which light sources 408, 410, and 412 are mounted. In this scenario, light source 408 is arranged on top of current source 402, light source 410 is arranged on top of current source 404 and light source 412 is arranged on top of current source 406.

Each current source 402, 404, and 406 may be an NMOS power stage with the drain connected to supply voltage VCC, and with the source connected with the respective light sources 408, 410, and 412. The gate of each NMOS power stage may be controlled via a corresponding error amplifier 414, 416, and 418, and each error amplifier 414, 416, and 418 may be used to control the output current using an internal reference current. Each error amplifier 414, 416, and 418 may be enabled by a digital or by an analog signal.

In light of the foregoing, driver circuitry 304 may thus comprise a relatively large number of current sources and/or switches on the area available for a pixel cell (in case the driver circuitry is physically below the light source array). Examples presented herein in particular show how an efficient solution for the light source array and the underlying driver circuitry may be realized even if the driver circuitry is arranged on a silicon semiconductor device (e.g., single chip). Examples provided in particular cope with a high number of heat sources as well as heat gradients between current sources of the pixel cells.

Other examples presented herein allow providing driver circuitry comprising in particular at least one of the following: a communication interface for controlling the drivers for each pixel cell; an output current regulation with self-protection against over-current; an open-load and short to ground diagnostic functionality; and a low temperature sensitivity. In some examples, the communication interface may be part of buffer circuitry. This may in particular be achieved by distributing a control logic between a circuitry and the driver circuitry, both integrated on a semiconductor device. The circuitry may be arranged adjacent to the driver circuitry and the driver circuitry may take the same surface area than the light source array, which can be arranged on top of the driver circuitry as explained above. As an option, the circuitry may be arranged in an area adjacent or distant to the driver circuitry.

It may be challenging to efficiently drive the current sources of the driver circuitry, where each current source is placed adjacent to (or associated with) a pixel cell. As shown in the example described above, the distance between two pixel cells (e.g., less than 150 μm) may set forth limiting restrictions, which makes it difficult to electrically connect all current sources that are arranged below their associated light sources such that they can be driven by the circuitry of the semiconductor device.

Figure 4B:
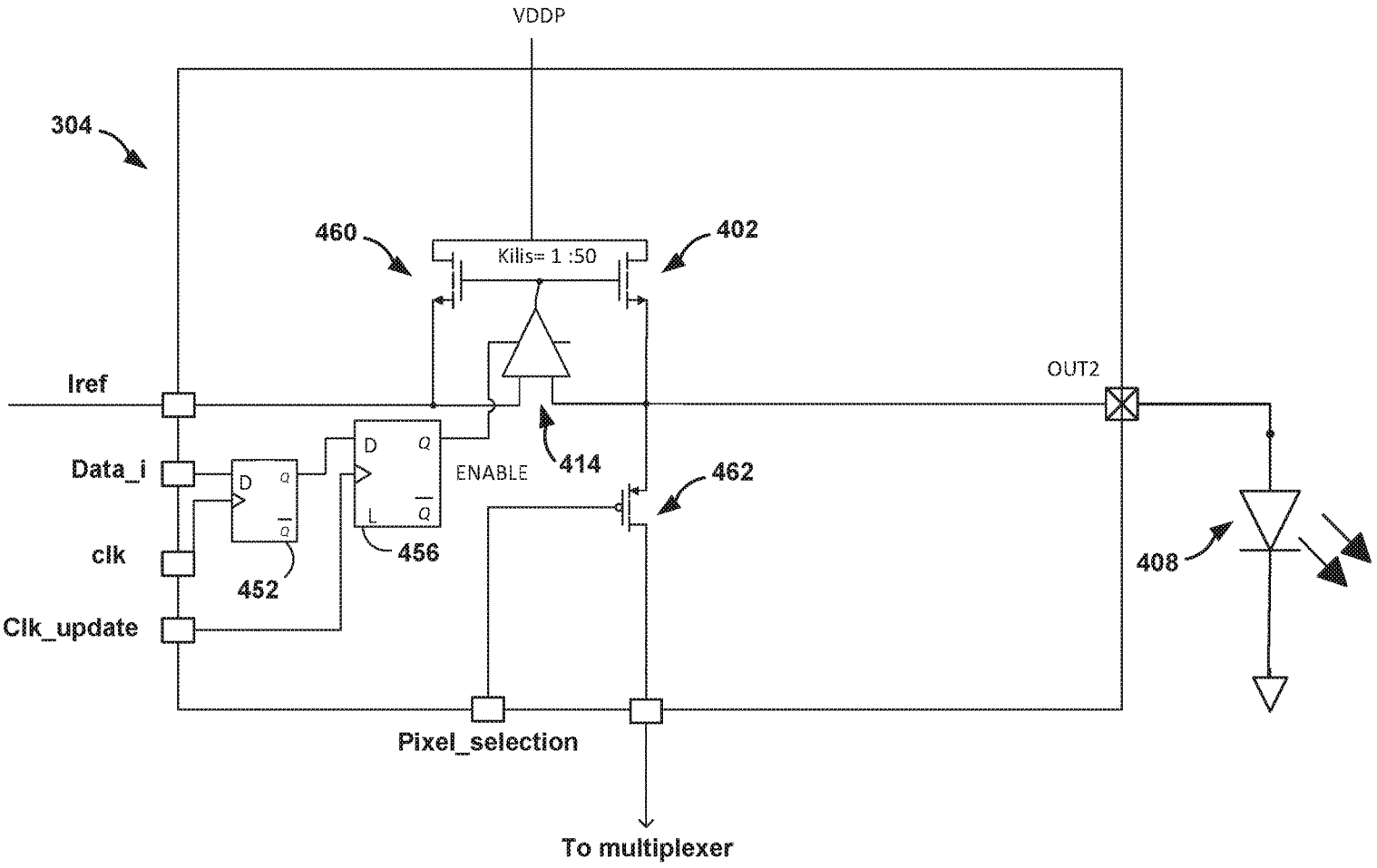
FIG. 4B shows an exemplary driver circuitry for a light source, in accordance with some examples of this disclosure.

FIG. 4B shows an exemplary driver circuitry 304 for light source 408, in accordance with some examples of this disclosure. FIG. 4B may also show buffer circuitry configured to receive and deliver a bit stream to driver circuitry 304. The buffer circuitry may include flip-flops 452 and 456. Flip-flop 452 may be configured to receive a bit of a bit stream at the node labeled "D" and from the node labeled Data_i. When flip-flop 452 receives an active clock signal from the node labeled clk, flip-flop 452 may be configured to output the bit at the node labeled "Q". When flip-flop 456 receives an active clock signal from the node labeled Clk_update, flip-flop 456 may be configured to output the bit at the node labeled "Q". In some examples, the bit may enable error amplifier 414 to drive current source 402 and reference switch 460.

Reference switch 460 may be configured to conduct a lower-amplitude electrical current than the electrical current conducted by current source 402. In some examples, the KILIS factor between reference switch 460 and current source 402 may be one to fifty, although other factors may also be used. Driver circuitry 304 may be configured to output the reference current conducted by reference switch 460 at the node labeled "Iref". Current source 402 may conduct an electrical current from a power supply labeled VDDP, and driver circuitry 304 may output the electrical current at the node labeled OUT2.

A device of this disclosure may include monitor circuitry configured to determine a voltage drop across light source 408. To determine the voltage drop across light source 408, the monitor circuitry may deliver a control signal through the node labeled Pixel_selection to the control terminal of switch 462. The control signal may cause switch 462 to transmit a voltage signal to a multiplexer (see FIG. 8), where the voltage signal may indicate the voltage drop. The voltage drop across light source 408 may be referred to as the forward voltage of light source 408. In some examples, the voltage drop across light source 408 may indicate the temperature of light source 408, whether there is a short circuit across light source 408, and/or whether there is an open circuit across light source 408.

Figure 5:
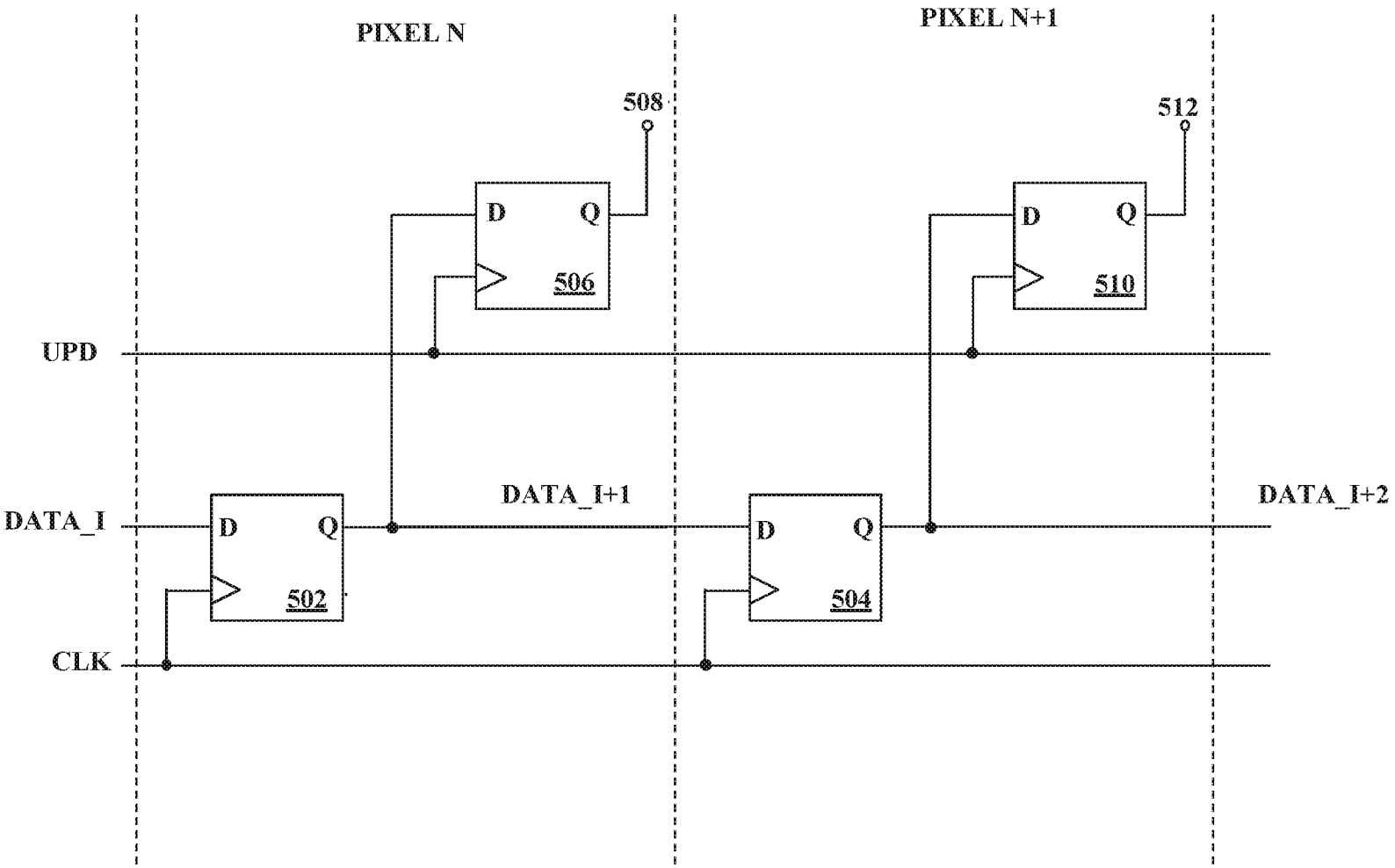
FIG. 5 shows exemplary buffer circuitry for receiving a bit stream, in accordance with some examples of this disclosure.

FIG. 5 shows an exemplary circuitry that may be arranged on a semiconductor device for two pixel cells N and N+1. In this example, circuitry 306 may supply an update signal UPD, a data signal DATA_I and a clock signal CLK. Pixel cell N may deliver a data signal DATA_I+1 to the pixel cell N+1, and pixel cell N+1 may deliver a data signal DATA_I+2 to a subsequent pixel cell (not shown).

In practice, data signal DATA_I may be a bit stream, i.e., a sequence of binary signals (e.g., "0" and "1") that are conveyed to a shift register. Each cell of the shift register may include a D-flip-flop, e.g., D-flip-flop 502 for pixel N and D-flip-flop 504 for pixel N+1. In this example, data signal DATA_I may be connected to the D-input of D-flip-flop 502, the Q-output of D-flip-flop 502 may be connected to the D-input of D-flip-flop 504. Both D-flip-flops 502 and 504 are driven by clock signal CLK. Hence, a sequence of "0" and "1" values may be conveyed to D-flip-flops 502 and 504, wherein with each clock cycle (rising edge) of clock signal CLK, the actual value stored in D-flip-flop 502 is shifted to subsequent D-flip-flop 504 and the subsequent value provided by data signal DATA_I is stored in D-flip-flop 502. According to the example shown, a bit sequence of first 0, then 1 is—after two clock cycles—stored in D-flip-flops 502 and 504 such that D-flip-flop 502 has a value "1" and D-flip-flop 504 has the value "0". D-flip-flops 502 and 504 may be a part of buffer circuitry 106.

A light source, e.g., the light source for pixel N, may be driven via a terminal 508 of a register, e.g., D-flip-flop 506. Similarly, a light source for pixel N+1 may be driven via a terminal 512 of a register, e.g., D-flip-flop 510. The D-input of D-flip-flop 506 may be connected to the Q-output of D-flip-flop 502 and the D-input of D-flip-flop 510 may be connected to the Q-output of D-flip-flop 504. The enable (or clock) inputs of both D-flip-flops 506 and 510 may be connected to update signal UPD. When update signal UPD becomes "1" the value stored in D-flip-flop 502 may become visible at the Q-output of D-flip-flop 506 and hence may be used to drive the light source for this pixel N. Accordingly, the value stored in D-flip-flop 504 may become visible at the Q-output of D-flip-flop 510 and hence may be used to drive the light source of pixel N+1. Hence, the shift register exemplarily shown in FIG. 5 comprises two cells, wherein the cell for pixel N may include D-flip-flop 502 and register 506 and the cell for pixel N+1 may include D-flip-flop 504 and register 510.

FIG. 5 shows only an exemplary excerpt of a sequence of two pixel cells. This approach, however, may be applied to a sequence of more than two pixel cells, e.g., a column or a row of a matrix of pixels. In addition, several rows or columns may be connected and represented by an even longer shift register. Insofar, the shift register may be used for providing a data signal to all pixels of a column or line or even matrix and to update the column, line or matrix at once.

In some examples, it may be desirable for the frequency of clock signal CLK to be high enough to fill the shift registers for such sequence of pixels before the update signal UPD is activated and before the values stored at that time in the respective shift register are used to control the pixels of this sequence, e.g., column or row of the matrix of pixels. Hence, a high refresh rate for each pixel may result in a high resolution of a PWM/PDM/PFM dimming. Therefore, a high clock frequency may be advantageous to ensure that information can be stored in the flip-flop of the shift-register before triggering the update signal. In some examples, buffer circuitry may receive a frame of a bit stream in approximately five microseconds. At the end of a frame of the bit stream, the buffer circuitry may receive an active update signal, causing flip-flops 506 and 510 to deliver the respective bits to respective terminals 508 and 512. Thus, the device may update the status of the light sources for every frame, which may last five microseconds in some examples.

By providing registers (e.g., D-flip-flops according to FIG. 5) in daisy-chain fashion (one pixel driving the next one) and arranging those registers together with the respective pixel cells, a single line may suffice to convey data signal DATA_I to a sequence of pixels, whereas otherwise each pixel would require a separate connection to convey the data signal for controlling this pixel. It is noted that any sort of register or memory may be used to achieve the result described above. The register may be a flip-flop, a latch, register or any other element with a memorizing functionality.

Figure 6:
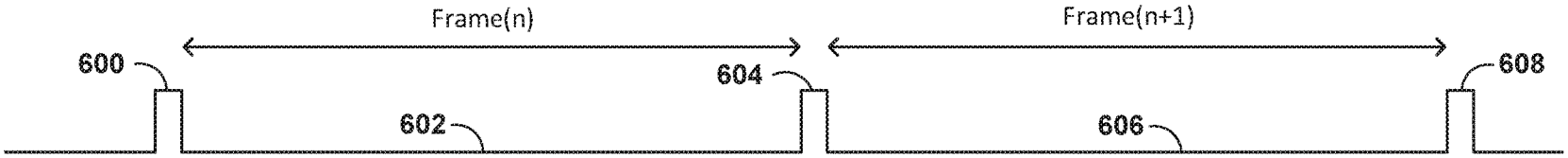
FIG. 6 illustrates a graph of an update signal for two frames of a bit stream, in accordance with some examples of this disclosure.

FIG. 6 illustrates a graph of an update signal for two frames of a bit stream, in accordance with some examples of this disclosure. The update signal is described with respect to device 100 in FIG. 1, although other devices and circuits in other FIGS. may also generate or receive update signals. Device 100 may include a communication serial interface consisting of a clock-, data-, and update-line based on a synchronous clock forward scheme. The clock signal, which may have the same frequency as the bit rate of bit stream 108, where it is provided the clock to be used as reference to sample the data and update signals. A frame may include a new state of all of light sources 104, and the update signal may mark the end of the frame, as well as any error-correction bits or error-checking bits. Device 100 may check incoming data for consistency, for example to determine if the frame length is correct. Device 100 may not store the incoming data, instead forwarding the new data to driver circuitry 110 when the frame ends. When the frame is complete and marked as valid, the new data may be applied to driver circuitry 110 and the states of the pixels are updated.

At the end of each frame of bit stream 108, device 100 may generate an update signal. The high pulse of the update signal may indicate the end of a frame and/or that the frame is free of transmission errors. In some examples, device 100 may deliver the update signal to buffer circuitry 106 and snooping circuitry 116. Device 100 may be configured to generate an update signal based on determining that a frame of bit stream 108 is complete and further based on not detecting any errors in the frame. Device 100 may be configured to check bit stream 108 for consistency, for example if frame length is correct.

During the time period that the update signal has low amplitude 602, buffer circuitry 106 may be receiving Frame (n) of bit stream 108 and driver circuitry 110 may be driving light sources 104 based on Frame(n−1) of bit stream 108. During the time period that the update signal has low amplitude 606, buffer circuitry 106 may be receiving Frame (n+1) of bit stream 108 and driver circuitry 110 may be driving light sources 104 based on Frame(n) of bit stream 108.

Buffer circuitry 106 may be configured to deliver the frame of bit stream 108 to driver circuitry 110 in response to receiving the update signal. In some examples, the phrase "receiving the update signal," as used herein, means receiving a high pulse of the update signal, such as one of pulses 600, 604, and 608. Snooping circuitry 116 may be configured to cause monitor circuitry 112 to determine voltage drop 114 in response to receiving the update signal, i.e., receiving one of high pulses 600, 604, and 608.

Figure 7:
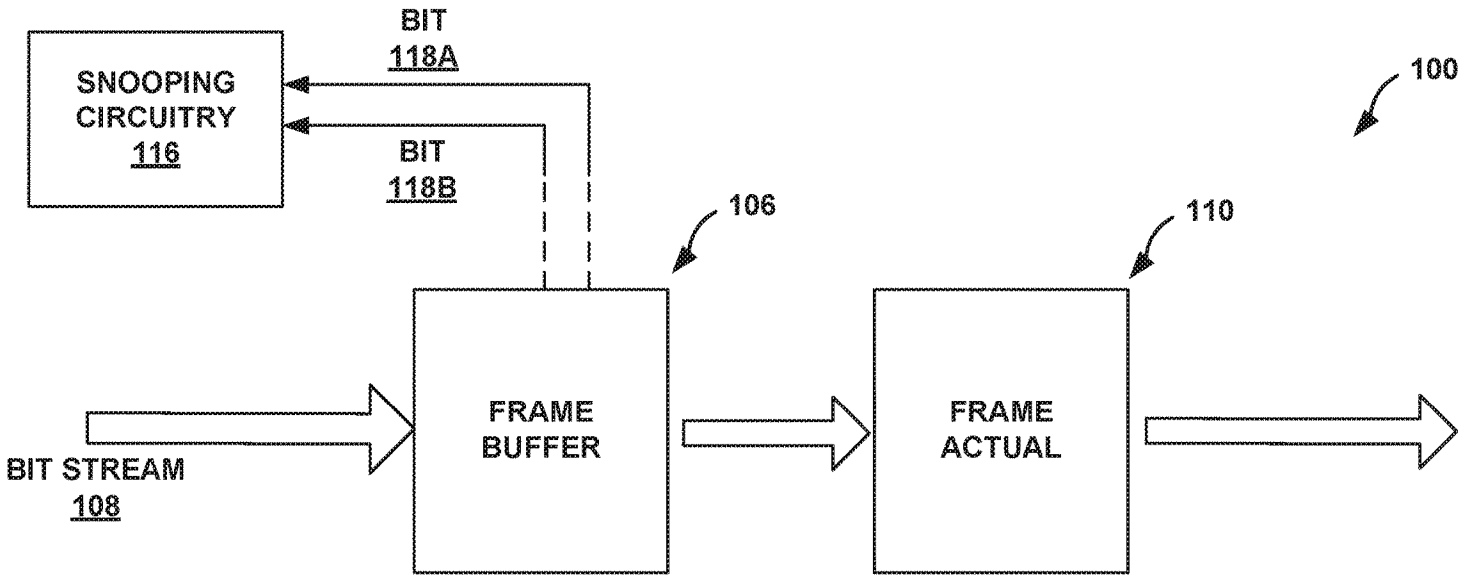
FIG. 7 is a conceptual block diagram of the device of FIG. 1, in accordance with some examples of this disclosure.

FIG. 7 is a conceptual block diagram of device 100, in accordance with some examples of this disclosure. Buffer circuitry 106 ("frame buffer") may be configured to receive a first frame of bit stream 108. As buffer circuitry 106 receives the first frame, snooping circuitry 116 may be configured to read bits 118A and 118B. Buffer circuitry 106 may be configured to hold and/or shift the first frame until buffer circuitry 106 receives an update signal. When buffer circuitry 106 receives the update signal, buffer circuitry 106 may be configured to deliver the first frame to driver circuitry 110 ("frame actual").

When driver circuitry 110 receives the first frame of bit stream 108, driver circuitry 110 may be configured to drive light sources 104 based on the first frame. As driver circuitry 110 is driving light sources 104 based on the first frame, buffer circuitry 106 may be receiving a second frame of bit stream 108. Driver circuitry 110 may be configured to store the first frame until buffer circuitry 106 and/or driver circuitry 110 receives an update signal. Driver circuitry 110 may be configured to update the states of light sources 104 based on each frame that driver circuitry 110 receives.

Buffer circuitry 106 may be implemented with a shift register acting as a frame buffer. In some examples, buffer circuitry 106 and/or driver circuitry 110 may include a shadow register holding the actual state of the pixels (see FIG. 5). The data is shifted into a shift register and as soon as the phase shift is completed, the data is written into the shadow register during the high-phase or high pulse of the update signal. The output of the shadow register may be connected to the respective pixel cell: if all the shift registers and shadow registers are placed in the common part of the silicon the consequence may be an increase of area. The increase in area may result in usage of all of the available metal connection and therefore routing congestion issues.

The shift register and shadow registers may be distributed across the pixel matrix with a slice in each pixel cell: in this way each pixel driver may drive the next one in a sort of daisy-chain. FIG. 5 shows an example of a serial interface slice including a flip flop (shift) and a latch (store element) placed in each cell. As a consequence, there may be no information in the common circuitry about the status of the pixels in order to not have a bigger area overhead (overhead may be equal to die area outside matrix area that in theory is useless).

In some examples, the sequence of pixels to be checked can be defined externally by the system. External control may be affected by the latency of the communication interface, for example an inter-integrated circuit (I2C) interface running at 1 megabits per second. It may be desirable to synchronize the diagnosis to the on state or active state of the pixel, which may be cumbersome and ineffective, in some examples. If there are several matrices to be diagnosed, the system may experience a substantially increased burden.

Additionally or alternatively, another device may include an internal ADC. The light source state information may be stored locally in the pixel area in order to optimize the die area and channel routability over the matrix. In such a case, a device may be configured to generate internally a sequence of pixels to be monitored, for example via a round robin scheme. The internal logic may be configured to synchronize the execution of the diagnosis to the active state of the pixel, which may result in time lost waiting for the desired light source state. In general, this configuration may result in worse time performance of the navigation across the matrix. This configuration may be overcome by having a replica of matrix states in the common area, which may result in a substantial increase in die area.

Figure 8:
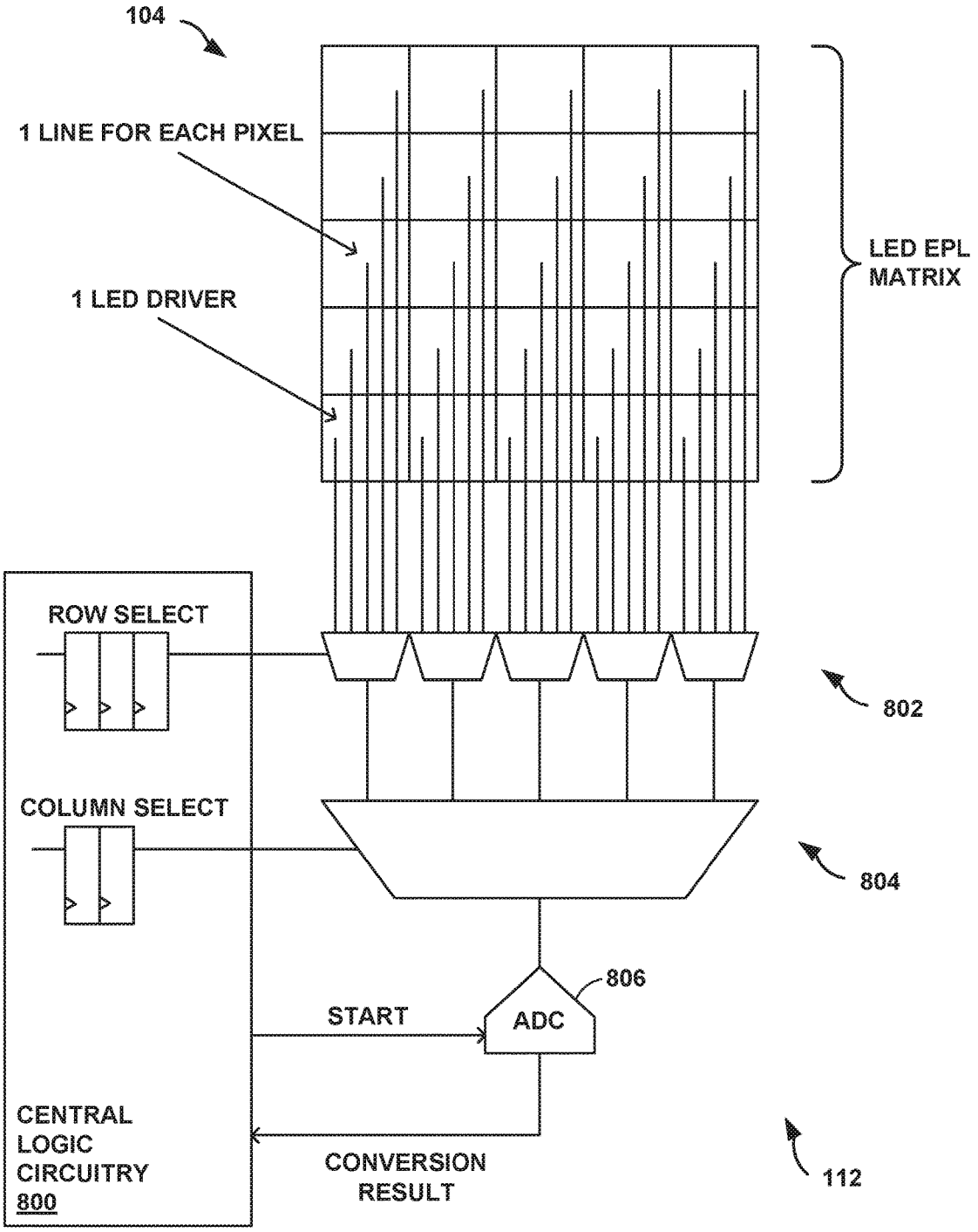
FIG. 8 illustrates monitor circuitry for determining a voltage drop across at least two light sources, in accordance with some examples of this disclosure.

FIG. 8 illustrates monitor circuitry 112 for determining a voltage drop across at least two light sources 104, in accordance with some examples of this disclosure. At a system level, it may be important to have the option to monitor operating condition of the current sources, which may include, for example, the voltage drop across them. The system may be configured to use the diagnosis information to determine the optimal voltage supply in order to minimize the power dissipation. The output voltages of the current sources may not necessarily be directly accessible because the pixels may be covered by the light sources chip. The pixel under monitor may be selectable by the user via a dedicated register. Monitor circuitry 112 may include analog multiplexers such as multiplexers 802 and 804 in order to have the selected output node accessible. ADC 806 may convert the selected voltage for further processing by a digital signal processor or a microcontroller. ADC 806 may be integrated in driver circuitry 110 or monitor circuitry 112 together with control logic such as central logic circuitry 800.

ADC 806 may convert the output voltage and/or the voltage drop across the current source. In some examples, a voltage comparator may be configured to compare the output voltage against a reference voltage. The system may be configured to request an ADC conversion for the selected pixel and/or to verify the status of the voltage comparator. The system may not know the light source state outside of the pixel cell and the control logic may be configured to determine which pixel is in an active state at that moment based on the bit values in a frame of the bit stream.

The system selects the pixel and the desired state for the conversion, and then the system requests an ADC conversion. One task of central logic circuitry 800 may be to synchronize the start of the ADC conversion to the actual state of the light sources. The state of the light source may not be known outside the pixel cell, and the central logic circuitry 800 may have to reconstruct such information. To avoid an overly burdensome reconstruction, snooping circuitry may look at or "snoop into" the incoming serial stream going to the shift register spread over the pixel matrix. The snooping circuitry may extract the bit corresponding to the pixel to be monitored. Additionally, the coherence with the matrix may be more likely because an invalid frame may not update the shadow register or the light source status flag. Central logic circuitry 800 may use the light source status flag to handle the ADC conversion, starting it in the right moment and eventually aborting it if the light source toggles during the conversion.

Central logic circuitry 800 may be configured to select a row and a column for a specific light source of light sources 104. Central logic circuitry 800 may be configured to deliver control signals to multiplexers 802 and 804. Multiplexer 804 may be configured to deliver an output signal to ADC 806 for conversion of the analog signal to a digital signal.

Multiplexers 802 may be configured to configured to receive, as inputs, voltage drop connections for each light source of light sources 104. Each of light sources 104 may include an electrical connection to one of multiplexers 802. As depicted in FIG. 8, light sources 104 may include five rows and five columns. In the example of FIG. 8, all of the light sources of a column may be electrically connected as inputs to one of multiplexers 802. Central logic circuitry 800 may be configured to connect one of light sources 104 to ADC 806 through multiplexers 802 and 804.

Central logic circuitry 800 may be configured to generate and/or receive inputs for row select and column select. For example, central logic circuitry 800 may select a specific light source at row one and column one. Central logic circuitry 800 may be configured to select the row and column based on the mapping of each of light sources 104. In some examples, central logic circuitry 800 may be configured to determine the row and column of the specific light source and to transmit the row and column coordinates to mapping circuitry. The mapping circuitry may be configured to convert the row and column coordinates to a position of a specific bit in a frame of a bit stream. Snooping circuitry may be configured to read the value of the specific bit based on the position determined by the mapping circuitry.

The system may be simplified by letting the driver circuitry autonomously manage the light source forward voltage diagnostic. The master chip may request a conversion to a dedicated pixel in a defined, or requested, state and then either read back the converted digital value or an error message if feature implemented. If multiple driver circuits are present the synchronization may be relatively simple, as compared to other devices that lack snooping circuitry. The snooping circuitry may synchronize an embedded ADC to the light source status for an intelligent silicon substrate designed to drive a matrix including light sources. By reading bits as the buffer circuitry receives the bit stream, the snooping circuitry may be configured to determine the status of the LED under diagnosis and send the status to the ADC controller. In some examples, a transmission error may cause the snooping circuitry to not send the status to the ADC controller.

In some examples, a device of this disclosure may be part of an adaptive driving beam front light system for a vehicle. The device may also be used for lighting, automotive, aviation, and/or any other suitable applications. The snooping circuitry of this disclosure helps the system to manage the monitoring of the forward voltage drop of each of light sources. The system may use voltage-drop information as a temperature monitor and to improve the thermal management of the system, reducing either the worst case margins or the thermal dissipation structures.

Figure 9:
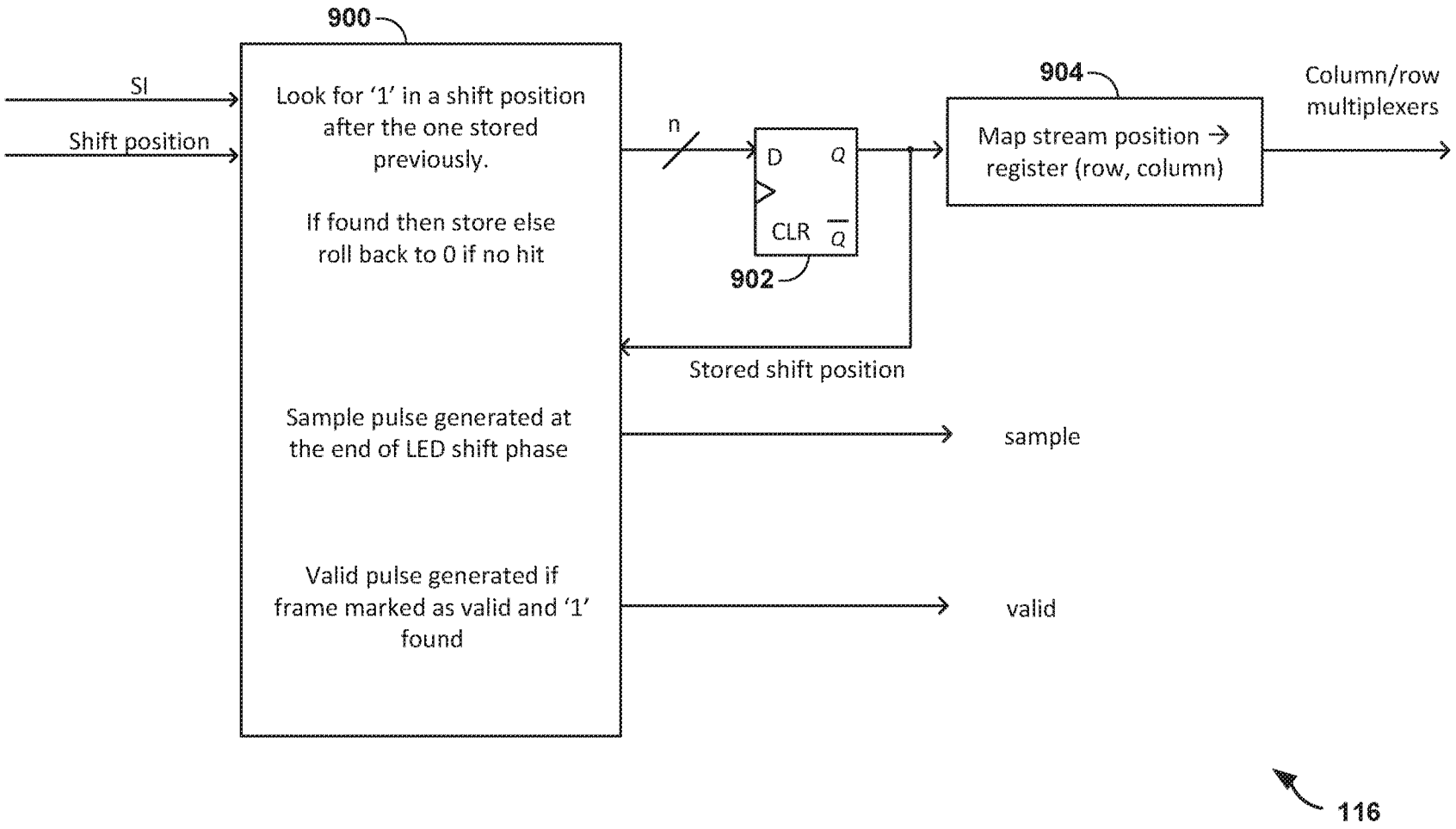
FIG. 9 is block diagram of snooping circuitry configured to look for an active bit, in accordance with some examples of this disclosure.

FIG. 9 is block diagram of snooping circuitry 116 configured to look for an active bit, in accordance with some examples of this disclosure. In the example of FIG. 9, snoop module 900 may be configured to receive a bit stream from a serial interface (SI). Snoop module 900 may also be configured to receive a position in the shift register of buffer circuitry. Snoop module 900 may be configured to count the position in the shift register to read a bit, looking for an active value (e.g., a "1") in the shift position. The shift position for a specific frame of the bit stream may be later (or after) in the bit stream than the previously stored shift position. In some examples, the current shift position may be one bit later in the bit stream than the previously stored shift position.

If snoop module 900 finds an active bit at the shift position, snoop module 900 may be configured to store the shift position in D flip flop 902. If snoop module 900 does not find an active bit at the shift position, snoop module 900 may be configured to read the next bit in the frame. If snoop module 900 reaches the end of the frame without finding an active bit, snoop module 900 may be configured to roll back to the beginning of the bit stream in the next frame. Snoop module 900 may be configured to "roll back" to the beginning by reading the first bit of the next frame in response to determining that the last bit of the previous frame had an inactive value.

Snoop module 900 may be configured to generate a sample pulse at the end of an LED shift phase, which may be the end of the frame. In some examples, snoop module 900 may generate the sample pulse after the end of the bits in the frame but before any error-checking bits. Snoop module 900 may be configured to generate a valid pulse if snoop module 900 has found an active bit in the frame and if snoop module 900 receives an update signal indicating that the frame is valid.

D flip flop 902 may be configured to deliver the stored shift position to snoop module 900 and mapping circuitry 904. Mapping circuitry 904 may be configured to convert the stored shift position (i.e., the stream position) to a row position and a column position. Mapping circuitry 904 may include a register or lookup table. Mapping circuitry 904 may be configured to deliver the row position and the column position to multiplexers (see FIG. 8) to cause the multiplexers to deliver a voltage drop from a desired pixel to an ADC.

Figure 10:
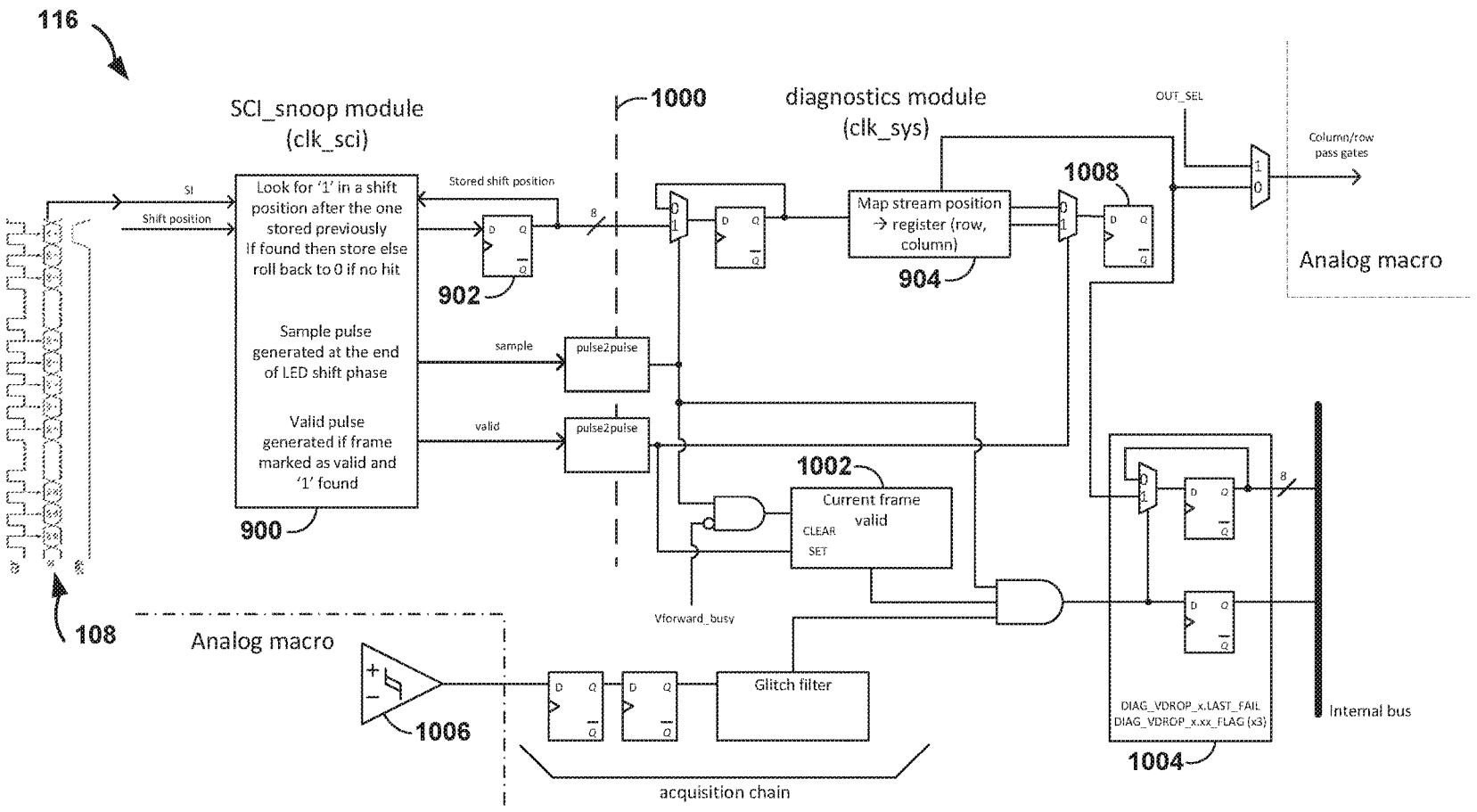
FIG. 10 is block diagram of snooping circuitry including a snoop module and a diagnostics module, in accordance with some examples of this disclosure.

FIG. 10 is block diagram of snooping circuitry 116 including a snoop module and a diagnostics module, in accordance with some examples of this disclosure. FIG. 10 depicts the synchronization between the serial interface (SI) of snoop module 900 and the diagnostic clock domains. Dividing line 1000 separates the clk_sci domain and the clk_sys domain. The valid signal may cause a multiplexer to deliver a position of a light source to D flip flop 1008. The valid signal may also cause circuitry 1002 to control the sampling of the voltage drop across a light source, as indicated by the output of comparator 1006.

The frame timings are used also to generate the sample event of comparator 1006, which may include an analog comparator. The diagnostics module may use a valid signal to both update the coordinates and gate the sampling of comparator 1006. Comparator 1006 may be connected to the pixel under diagnosis. Comparator 1006 may be configured to compare the voltage drop across a light source to a threshold voltage. The output of comparator 1006 may indicate whether the voltage drop is within an acceptable range. The acquisition chain may filter the output of comparator 1006, and D flip flops 1004 may be configured to store and deliver indications of the voltage drop across the light source. D flip flops 1004 may be configured to store a flag that indicates whether the light source has a voltage drop within the acceptable range. The internal bus may allow device 100 and/or another device to access the flag.

Figure 11:
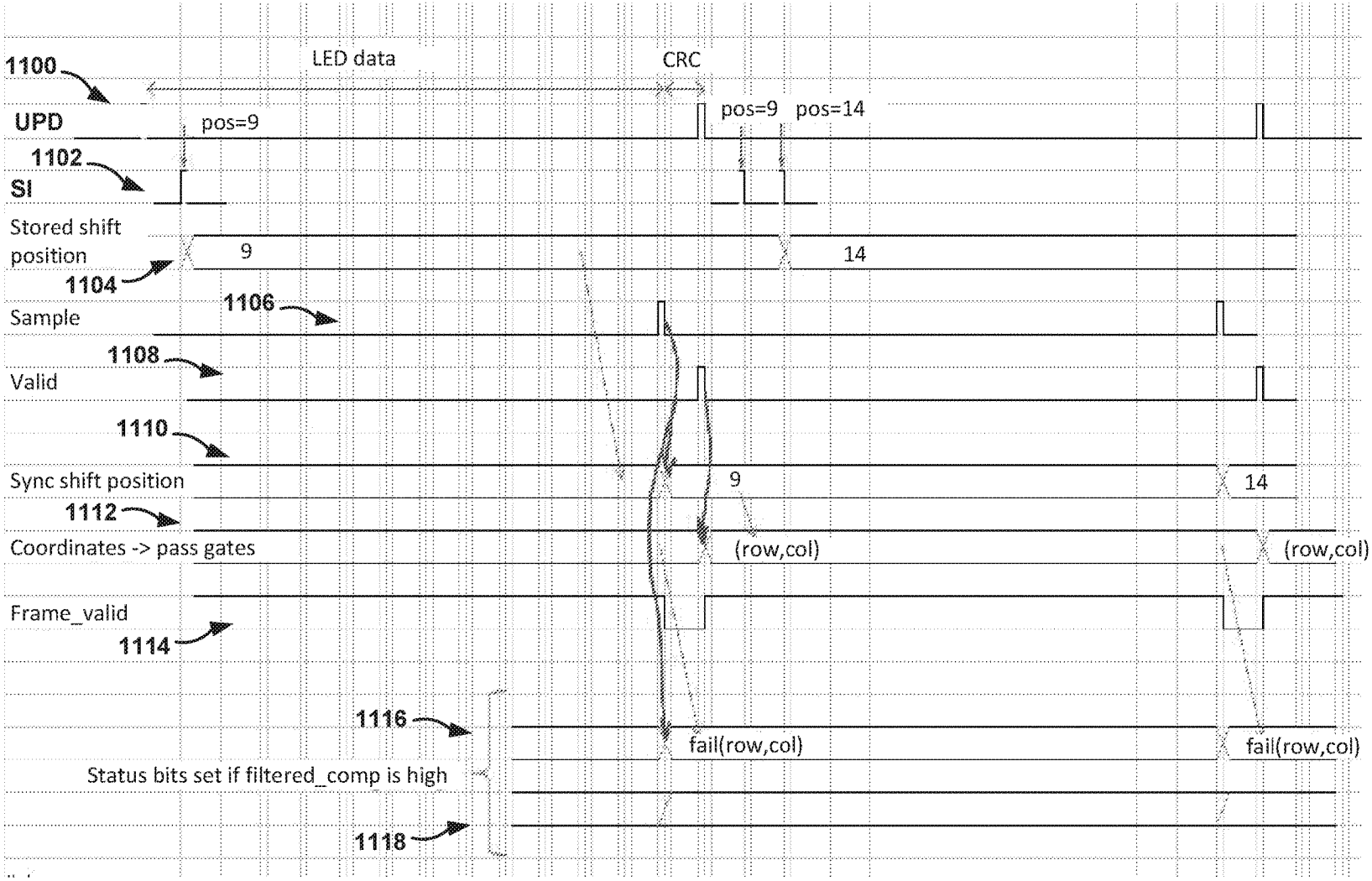
FIG. 11 is a timing diagram of an update signal and a bit stream including one or more inactive bits, in accordance with some examples of this disclosure.

FIG. 11 is a timing diagram of an update signal 1100 and a bit stream 1102 including one or more inactive bits, in accordance with some examples of this disclosure. Update signal 1100 may include a high pulse at the end of each frame of the bit stream, and after cyclic redundancy check (CRC) bits. In a first frame of a bit stream 1102 received at a serial interface (SI), the ninth bit may have an active value. Register 1104 may be configured to store the shift position for the ninth bit as or just after the snooping circuitry reads the ninth bit. During the second frame of the bit stream, the snoop module may be configured to start by reading the tenth bit of the frame. The tenth bit, eleventh bit, twelfth bit, and the thirteenth bit may have inactive values, causing the snoop module to continue reading up to the fourteenth bit, which may have an active value. Snoop module may be configured to store shift position fourteen based on determining that the fourteenth bit has an active value.

A high pulse in sample signal 1106 may indicate the end of the bits in a frame. Register 1110 may be configured to store the shifted position in response to the high pulse in sample signal 1106. Registers 1116 and 1118 may be configured to set status bits if filtered_comp is high. A high pulse in valid signal 1108 may indicate that error-checking circuitry has not found any errors in the frame. If the frame is marked as valid, register 1112 may be configured to store the row and column coordinates in response to the high pulse in valid signal 1108. The row and column coordinates may be multiplexer settings, as shown in FIG. 8. The high pulse in sample signal 1106 may cause frame_valid signal 1114 to have a low value until the high pulse in valid signal 1108.

The high pulse in sample signal 1106 at the end of the second frame may cause monitor circuitry to sample the position stored in register 1112, which corresponds to the ninth bit. The delay between storing the coordinates in register 1112 at the beginning of the second frame and sampling the ninth bit at the end of the second frame may allow the output signal of a comparator to settle to reduce noise in the output signal. The delay may also allow for accurate sampling of the voltage drop by the ADC.

Figure 12:
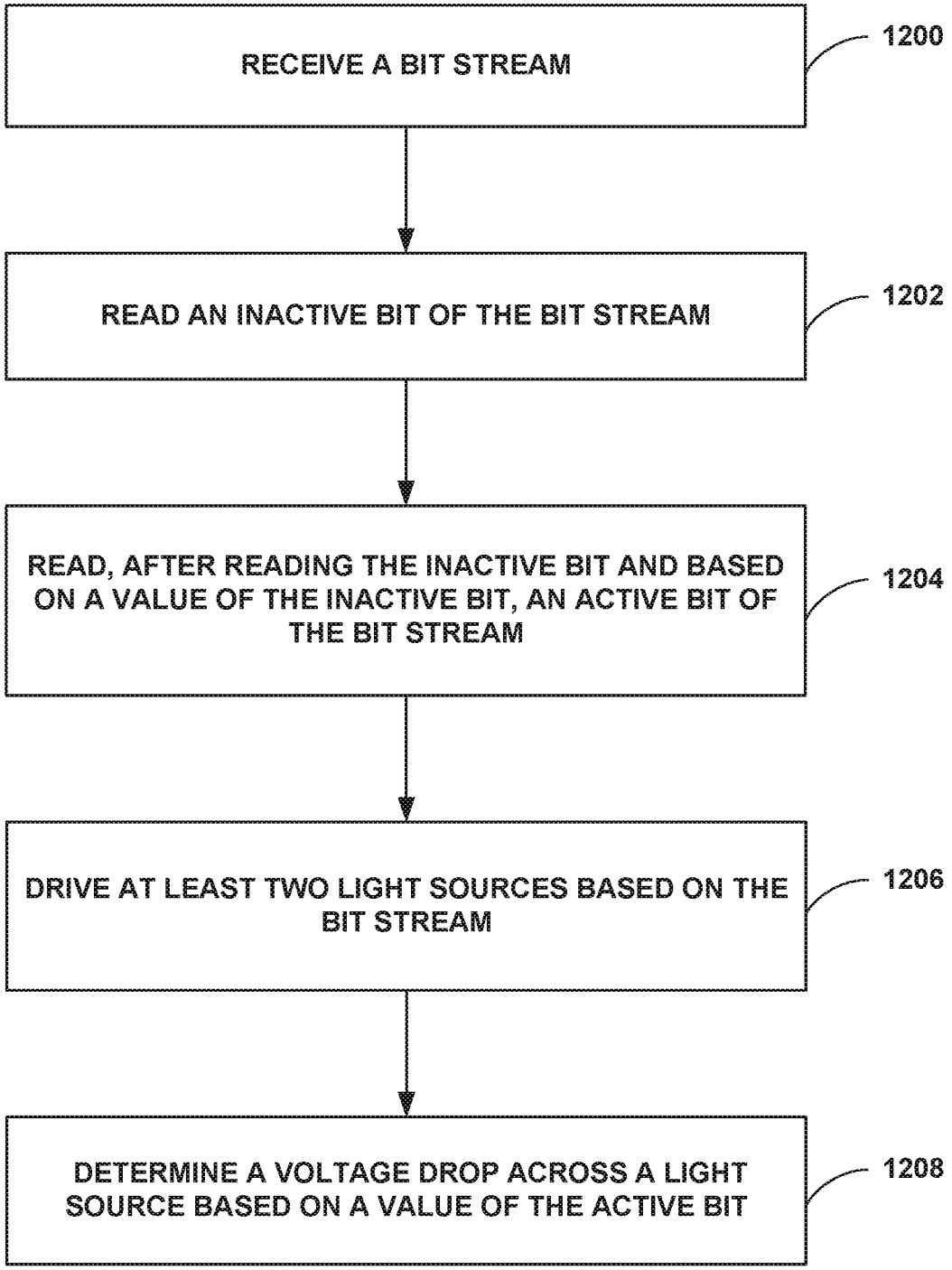
FIGS. 12 and 13 are flowcharts illustrating example techniques for determining a voltage drop across a light source, in accordance with some examples of this disclosure.
Figure 13:
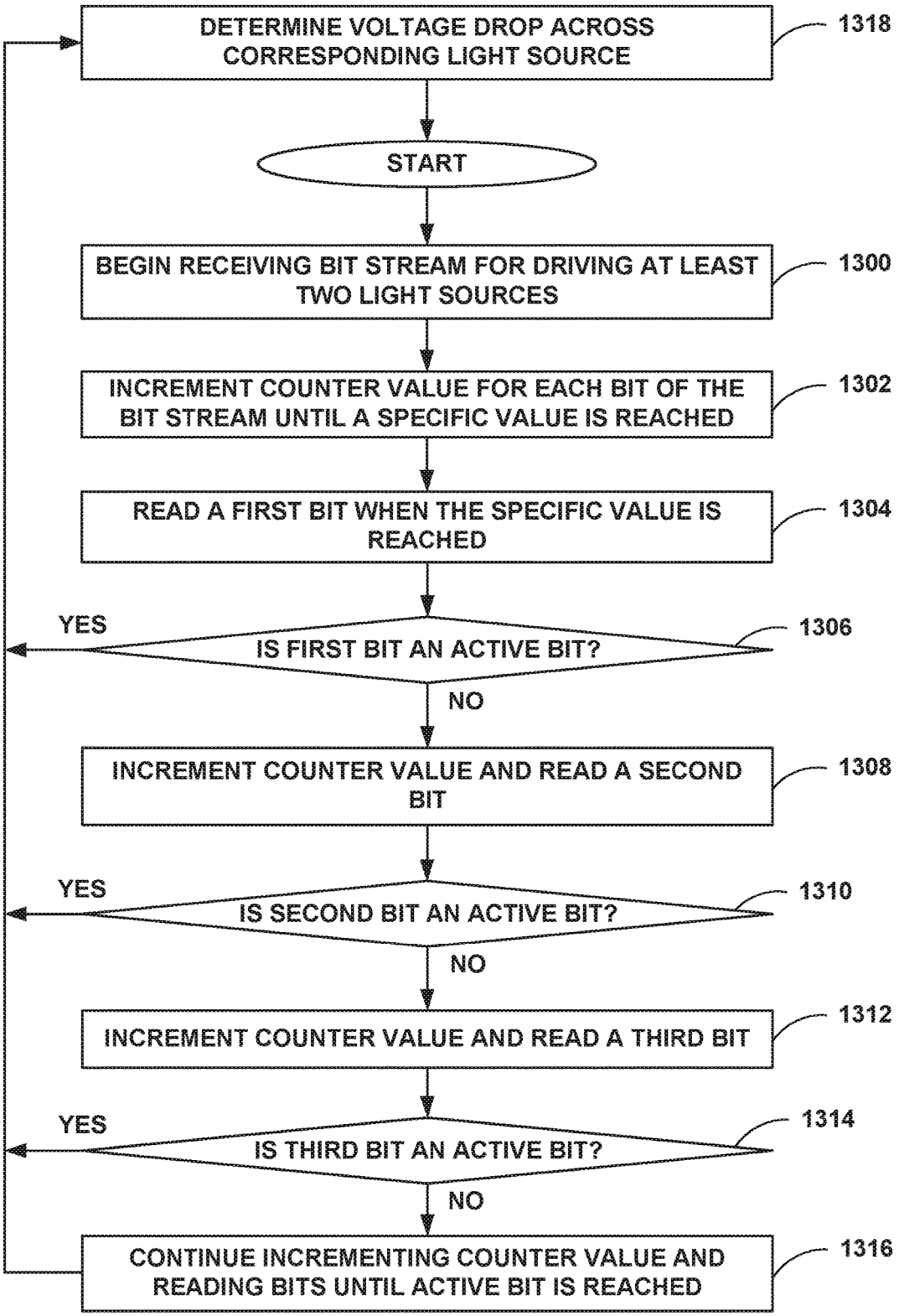

FIGS. 12 and 13 are flowcharts illustrating example techniques for determining a voltage drop across a light source, in accordance with some examples of this disclosure. The techniques of FIGS. 12 and 13 are described with reference to device 100 in FIG. 1, although other components, such as semiconductor device 310 in FIG. 3 and snooping circuitry 116 in FIGS. 1, 7, 9, and 10, may exemplify similar techniques.

The techniques of FIG. 12 include buffer circuitry 106 receiving bit stream 108 (1200). Buffer circuitry 106 may include a shift register configured to receive a frame of bit stream 108. Each flip flop of the shift register may be configured to receive each bit of the frame of bit stream 108. When buffer circuitry 106 has received the frame of bit stream 108, buffer circuitry 106 may be configured to receive an update signal indicating the end of the frame. The update signal may also indicate that the frame does not include any errors. In response to receiving the update signal, buffer circuitry 106 may be configured to deliver the frame of bit stream 108 to driver circuitry 110.

The techniques of FIG. 12 further include snooping circuitry 116 reading inactive bit 118A (1202). Snooping circuitry 116 may include counter circuitry configured to count the position of bit 118A in a frame of bit stream 108 as buffer circuitry 106 receives the frame. The counter circuitry may be configured to cause snooping circuitry 116 to read the value of bit 118A in response to counting the position of bit 118A. In some examples, snooping circuitry 116 may be configured to read bit 118A as buffer circuitry 106 receives bit 118A. Bit 118A may have an inactive bit value, such as '0', such that driver circuitry 110 may be configured to refrain from driving a respective light source based on the value of bit 118A.

The techniques of FIG. 12 further include snooping circuitry 116 reading active bit 118B after reading bit 118A and based on a value of bit 118A (1204). In some examples, bit 118B may immediately follow bit 118A. Bit 118B may have an active bit value, such as '1', such that driver circuitry 110 may be configured to drive a respective light source based on the value of bit 118B. Snooping circuitry 116 may be configured to store the position of bit 118B in a register in response to determining that bit 118B has an active bit value.

The techniques of FIG. 12 further include driver circuitry 110 driving at least two light sources based on bit stream 108 (1206). Driver circuitry 110 may be configured to receive the frame of bit stream 108 in response to buffer circuitry 106 receiving the update signal. In some examples, driver circuitry 110 may be configured to deliver an electrical current to a light source based on a high value of a corresponding bit in bit stream 108. Driver circuitry 110 may be configured to refrain from delivering an electrical current to a light source based on a low value of a corresponding bit in bit stream 108.

The techniques of FIG. 12 further include monitor circuitry 112 determining a voltage drop 114 across a light source based on a value of bit 118B (1208). The light source may be mapped to bit 118B such that driver circuitry 110 may be configured to drive the light source based on the value of bit 118B. Additionally or alternatively, monitor circuitry 112 may be configured to determine the voltage drop across a current source in driver circuitry 110, where the current source is configured to drive the light source. Monitor circuitry 112 may also be configured to determine whether there is a short circuit or open circuit across the light source.

The techniques of FIG. 13 include buffer circuitry 106 beginning to receive bit stream 108 for driving light sources 104 (1300). Buffer circuitry 106 may be configured to receive bit stream 108 in descending order, such that buffer circuitry 106 first receives a bit corresponding to the last of light sources 104. The techniques of FIG. 13 further include snooping circuitry 116 incrementing a counter value for each bit of bit stream 108 until a specific value is reached (1302). Snooping circuitry 116 may be configured to clear the counter value at the end of each frame. The counter value may be a digital value stored by counter circuitry of snooping circuitry 116.

The techniques of FIG. 13 further include snooping circuitry 116 reading a first bit when the specific value is reached (1304). If the first bit is an active bit (1306), the techniques of FIG. 13 further include determining the voltage drop across a light source corresponding to the first bit (1318). If the first bit is not an active bit, the techniques of FIG. 13 further include snooping circuitry 116 incrementing the counter value and reading a second bit (1308). The second bit may immediately follow the first bit in bit stream 106.

If the second bit is an active bit (1310), the techniques of FIG. 13 further include determining the voltage drop across a light source corresponding to the second bit (1318). If the second bit is not an active bit, the techniques of FIG. 13 further include snooping circuitry 116 incrementing the counter value and reading a third bit (1312).

If the third bit is an active bit (1314), the techniques of FIG. 13 further include determining the voltage drop across a light source corresponding to the third bit (1318). If the third bit is not an active bit, the techniques of FIG. 13 further include snooping circuitry 116 incrementing the counter value and reading bits until an active bit is reached (1316). If snooping circuitry 116 reaches the end of a frame of bit stream 108 without reading an active bit, snooping circuitry 116 may be configured to read the first bit at the beginning of the next frame of bit stream 108.

The techniques of this disclosure may be implemented in a device or article of manufacture comprising a computer-readable storage medium. The term "processing circuitry," as used herein may refer to any of the foregoing structure or any other structure suitable for processing program code and/or data or otherwise implementing the techniques described herein. Elements of device 100, buffer circuitry 106, driver circuitry 110, monitor circuitry 112, snooping circuitry 116, and/or controller circuitry 120 may be implemented in any of a variety of types of solid state circuit elements, such as CPUs, CPU cores, GPUs, digital signal processors (DSPs), application-specific integrated circuits (ASICs), a mixed-signal integrated circuits, field programmable gate arrays (FPGAs), microcontrollers, programmable logic controllers (PLCs), programmable logic device (PLDs), complex PLDs (CPLDs), a system on a chip (SoC), any subsection of any of the above, an interconnected or distributed combination of any of the above, or any other integrated or discrete logic circuitry, or any other type of component or one or more components capable of being configured in accordance with any of the examples disclosed herein. Processing circuitry may also include analog components arranged in a mixed-signal IC.

Device 100, buffer circuitry 106, driver circuitry 110, monitor circuitry 112, snooping circuitry 116, and/or controller circuitry 120 may include memory. One or more memory devices of the memory may include any volatile or non-volatile media, such as a RAM, ROM, non-volatile RAM (NVRAM), electrically erasable programmable ROM (EEPROM), flash memory, and the like. One or more memory devices of the memory may store computer readable instructions that, when executed by the processing circuitry, cause the processing circuitry to implement the techniques attributed herein to the processing circuitry.

Elements of device 100, buffer circuitry 106, driver circuitry 110, monitor circuitry 112, snooping circuitry 116, and/or controller circuitry 120 may be programmed with various forms of software. The processing circuitry may be implemented at least in part as, or include, one or more executable applications, application modules, libraries, classes, methods, objects, routines, subroutines, firmware, and/or embedded code, for example. The processing circuitry may be configured to receive voltage signals, determine switching frequencies, and deliver control signals.

The techniques of this disclosure may be implemented in a wide variety of computing devices. Any components, modules or units have been described to emphasize functional aspects and does not necessarily require realization by different hardware units. The techniques described herein may be implemented in hardware, software, firmware, or any combination thereof. Any features described as modules, units or components may be implemented together in an integrated logic device or separately as discrete but interoperable logic devices. In some cases, various features may be implemented as an integrated circuit device, such as an integrated circuit chip or chipset.

The following numbered examples demonstrate one or more aspects of the disclosure.

Example 1

A device includes at least two light sources, buffer circuitry configured to receive a bit stream, and driver circuitry configured to receive the bit stream from the buffer circuitry and to drive the at least two light sources based on the bit stream. In some examples, the device further includes monitor circuitry configured to determine a voltage drop across each light source of the at least two light sources and snooping circuitry configured to read an inactive bit of the bit stream. In some examples, the snooping circuitry is further configured to read an active bit of the bit stream after reading the inactive bit and based on a value of the inactive bit and to cause the monitor circuitry to determine a voltage drop across a light source of the at least two light sources based on a value of the active bit.

Example 2

The device of example 1, wherein the inactive bit is a first inactive bit, wherein the snooping circuitry is further configured to read, after reading the inactive bit and based on a value of the inactive bit, a second inactive bit of the bit stream, wherein the snooping circuitry is configured to read the active bit after reading the second inactive bit and based on a value of the second inactive bit.

Example 3

The device of examples 1-2 or any combination thereof, wherein the snooping circuitry is further configured to receive, after reading the active bit, an update signal indicating that the buffer circuitry has received the bit stream, wherein the snooping circuitry is configured to cause the monitor circuitry to determine the voltage drop across the active light source based on receiving the update signal.

Example 4

The device of examples 1-3 or any combination thereof, wherein the light source is a second light source, wherein driver circuitry is configured to refrain from driving a first light source based on a value of the inactive bit and drive the second light source based on a value of the active bit.

Example 5

The device of examples 1-4 or any combination thereof, further including counter circuitry configured to increment a counter value in response to receiving each bit of the bit stream until the counter value is a specific value and to determine whether the counter value is a specific value. The counter circuitry is further configured to cause the snooping circuitry to read the inactive bit in response to determining that the counter value is the specific value and to continue to increment the counter value in response to determining that the counter value is not the specific value.

Example 6

The device of example 5, wherein the snooping circuitry is further configured to determine that a value of the inactive bit is not an active value and to cause the counter circuitry to increment the counter value in response to determining that the value of the inactive bit is not the active value. The snooping circuitry is further configured to determine that a value of the active bit is an active value, and store the counter value in response to determining that the value of the active bit is the active value.

Example 7

The device of examples 5-6 or any combination thereof, wherein the inactive bit is a first inactive bit, and wherein the snooping circuitry is further configured to read the second inactive bit in response to determining that the value of the inactive bit is not the active value and to determine that a value of the second inactive bit is not an active value. The snooping circuitry is further configured to cause the counter circuitry to increment the counter value in response to determining that the value of the second inactive bit is not the active value, wherein the snooping circuitry is configured to read the active bit in response to determining that the value of the second inactive bit is not the active value.

Example 8

The device of examples 1-7 or any combination thereof, wherein the buffer circuitry is further configured to receive an update signal and to deliver a first frame of the bit stream to the driver circuitry in response to receiving the update signal, wherein the snooping circuitry is further configured to receive, after reading the active bit, the update signal and to cause the monitor circuitry to determine the voltage drop across the active light source in response to receiving the update signal.

Example 9

The device of examples 5-8 or any combination thereof, wherein the bit stream includes the first frame and a second frame, wherein the buffer circuitry is further configured to receive a second frame after receiving the update signal, wherein the counter circuitry is further configured to clear the counter value in response to the update signal. The counter circuitry is also configured to increment the counter value in response to receiving each bit of the second frame until the counter value is the stored counter value and to determine whether the counter value is the stored counter value. The counter circuitry is configured to cause the snooping circuitry to read a first bit of the second frame in response to determining that the counter value is the stored counter value, wherein a position of the first bit in the second frame is later than a position of the active bit and later than a position of the inactive bit and to continue to increment the counter value in response to determining that the counter value is not the specific value.

Example 10

The device of examples 5-9 or any combination thereof, wherein the snooping circuitry is further configured to determine whether a value of the first bit of the second frame is an active value and to cause the monitor circuitry to determine a voltage drop across a light source of the at least two light sources in response to determining that the value of the first bit of the second frame is the active value. The snooping circuitry is also configured to store the counter value in response to determining that the value of the first bit of the second frame is the active value and to cause the counter circuitry to increment the counter value in response to determining that the value of the first bit of the second frame is not the active value. The snooping circuitry is configured to read a second bit of the second frame in response to determining that the value of the first bit of the second frame is not the active value.

Example 11

A method includes receiving a bit stream, reading an inactive bit of the bit stream, and reading an active bit of the bit stream, after reading the inactive bit and based on a value of the inactive bit. The method further includes driving at least two light sources based on the bit stream and determining a voltage drop across a light source of the at least two light sources based on a value of the active bit.

Example 12

The method of example 11, wherein the inactive bit is a first inactive bit, and the method further includes reading a second inactive bit of the bit stream, after reading the inactive bit and based on a value of the inactive bit. The method also includes reading the active bit after reading the second inactive bit and based on a value of the second inactive bit.

Example 13

The method of examples 11-12 or any combination thereof, further including receiving, after reading the active bit, an update signal indicating that receiving the bit stream is complete, wherein determining the voltage drop across the active light source is further based on receiving the update signal.

Example 14

The method of examples 11-13 or any combination thereof, further including incrementing a counter value in response to receiving each bit of the bit stream until the counter value is a specific value and determining whether the counter value is a specific value. The method also includes reading the inactive bit in response to determining that the counter value is the specific value and continuing to increment the counter value in response to determining that the counter value is not the specific value.

Example 15

The method of example 14, further including determining that a value of the inactive bit is not an active value and incrementing the counter value in response to determining that the value of the inactive bit is not the active value. The method also includes determining that a value of the active bit is an active value and storing the counter value in response to determining that the value of the active bit is the active value.

Example 16

The method of examples 14-15 or any combination thereof, wherein the inactive bit is a first inactive bit, and the method further includes reading the second inactive bit in response to determining that the value of the inactive bit is not the active value. The method also includes determining that a value of the second inactive bit is not an active value and incrementing the counter value in response to determining that the value of the second inactive bit is not the active value. The method includes reading the active bit in response to determining that the value of the second inactive bit is not the active value.

Example 17

The method of examples 11-16 or any combination thereof, further including receiving an update signal after reading the active bit, wherein driving the at least two light sources is in response to receiving the update signal. The method also includes determining the voltage drop across the active light source is further based on receiving the update signal.

Example 18

The method of examples 14-17 or any combination thereof, wherein the bit stream includes a first frame and a second frame, and the method further includes receiving the second frame after receiving the update signal. The method also includes clearing the counter value in response to the update signal and incrementing the counter value in response to receiving each bit of the second frame until the counter value is the stored counter value. The method includes determining whether the counter value is the stored counter value and reading a first bit of the second frame in response to determining that the counter value is the stored counter value, wherein a position of the first bit in the second frame is later than a position of the active bit and later than a position of the inactive bit. The method further includes continuing to increment the counter value in response to determining that the counter value is not the specific value.

Example 19

The method of examples 14-18 or any combination thereof, further including determining whether a value of the first bit of the second frame is an active value and determining a voltage drop across a light source of the at least two light sources in response to determining that the value of the first bit of the second frame is the active value. The method also includes storing the counter value in response to determining that the value of the first bit of the second frame is the active value and incrementing the counter value in response to determining that the value of the first bit of the second frame is not the active value. The method includes reading a second bit of the second frame in response to determining that the value of the first bit of the second frame is not the active value.

Example 20

A device includes at least two light sources, buffer circuitry configured to receive a bit stream, and driver circuitry configured to receive the bit stream from the buffer circuitry and to drive the at least two light sources based on the bit stream. In some examples, the device further includes monitor circuitry configured to determine a voltage drop across each light source of the at least two light sources and snooping circuitry configured to read an inactive bit of the bit stream. In some examples, the snooping circuitry is further configured to read an active bit of the bit stream after reading the inactive bit and based on a value of the inactive bit and to cause the monitor circuitry to determine a voltage drop across a light source of the at least two light sources based on a value of the active bit. The device includes controller circuitry configured to determine whether the voltage drop across the light source is within an acceptable voltage window and to cause the driver circuitry to increase or decrease the voltage drop across the light source in response to determining whether the voltage drop across the light source is not within the acceptable voltage window.

Various examples of the disclosure have been described. Any combination of the described systems, operations, or functions is contemplated. These and other examples are within the scope of the following claims.

What is claimed is:

1. A device comprising:

at least two light sources;

buffer circuitry configured to receive a bit stream;

driver circuitry configured to:

receive the bit stream from the buffer circuitry, wherein each bit of the bit stream indicates whether the driver circuitry will drive a respective light source of the at least two light sources; and drive the at least two light sources based on the bit stream;

monitor circuitry configured to determine a voltage drop across each light source of the at least two light sources; and snooping circuitry configured to:

read an inactive bit of the bit stream, wherein the inactive bit indicates that the driver circuitry will not drive a first light source of the at least two light sources;

read, after reading the inactive bit, an active bit of the bit stream, wherein the active bit indicates that the driver circuitry will drive a second light source of the at least two light sources, wherein the first light source is different than the second light source; and cause the monitor circuitry to determine a voltage drop across the second light source responsive to reading the active bit.

2. The device of claim 1, wherein the inactive bit is a first inactive bit, wherein the snooping circuitry is further configured to read, after reading the inactive bit and based on a value of the inactive bit, a second inactive bit of the bit stream, wherein the inactive bit indicates that the driver circuitry will not drive a third light source of the at least two light sources, wherein the third light source is different than the first light source and the second light source, and wherein the snooping circuitry is configured to read the active bit after reading the second inactive bit and based on a value of the second inactive bit.

3. The device of claim 1, wherein the snooping circuitry is further configured to receive, after reading the active bit, an update signal indicating that the buffer circuitry has received the bit stream, and wherein the snooping circuitry is configured to cause the monitor circuitry to determine the voltage drop across the first light source based on receiving the update signal.

4. The device of claim 1, wherein the light source is a second light source, wherein driver circuitry is configured to:

refrain from driving the first light source based on a value of the inactive bit; and drive the second light source based on a value of the active bit.

5. The device of claim 1, further comprising counter circuitry configured to:

increment a counter value in response to receiving each bit of the bit stream until the counter value is a specific value;

determine whether the counter value is a specific value;

cause the snooping circuitry to read the inactive bit in response to determining that the counter value is the specific value; and continue to increment the counter value in response to determining that the counter value is not the specific value.

6. The device of claim 5, wherein the snooping circuitry is further configured to:

determine that a value of the inactive bit is not an active value;

cause the counter circuitry to increment the counter value in response to determining that the value of the inactive bit is not the active value;

determine that a value of the active bit is an active value; and store the counter value in response to determining that the value of the active bit is the active value.

7. The device of claim 6, wherein the inactive bit is a first inactive bit, and wherein the snooping circuitry is further configured to:

read the second inactive bit in response to determining that the value of the inactive bit is not the active value;

determine that a value of the second inactive bit is not an active value; and cause the counter circuitry to increment the counter value in response to determining that the value of the second inactive bit is not the active value, wherein the snooping circuitry is configured to read the active bit in response to determining that the value of the second inactive bit is not the active value.

8. The device of claim 6, wherein the buffer circuitry is further configured to receive an update signal and to deliver a first frame of the bit stream to the driver circuitry in response to receiving the update signal, and wherein the snooping circuitry is further configured to:

receive, after reading the active bit, the update signal; and cause the monitor circuitry to determine the voltage drop across the first light source in response to receiving the update signal.

9. The device of claim 8, wherein the bit stream includes the first frame and a second frame, wherein the buffer circuitry is further configured to receive a second frame after receiving the update signal, and wherein the counter circuitry is further configured to:

clear the counter value in response to the update signal;

increment the counter value in response to receiving each bit of the second frame until the counter value is the stored counter value;

determine whether the counter value is the stored counter value;

cause the snooping circuitry to read a first bit of the second frame in response to determining that the counter value is the stored counter value, wherein a position of the first bit in the second frame is later than a position of the active bit and later than a position of the inactive bit; and continue to increment the counter value in response to determining that the counter value is not the specific value.

10. The device of claim 9, wherein the snooping circuitry is further configured to:

determine whether a value of the first bit of the second frame is an active value;

cause the monitor circuitry to determine a voltage drop across the first light source in response to determining that the value of the first bit of the second frame is the active value;

store the counter value in response to determining that the value of the first bit of the second frame is the active value;

cause the counter circuitry to increment the counter value in response to determining that the value of the first bit of the second frame is not the active value; and read a second bit of the second frame in response to determining that the value of the first bit of the second frame is not the active value.

11. A method comprising:

receiving a bit stream, wherein each bit of the bit stream indicates whether driver circuitry will drive a respective light source of at least two light sources;

reading an inactive bit of the bit stream, wherein the inactive bit indicates that the driver circuitry will not drive a first light source of the at least two light sources;

reading, after reading the inactive bit, an active bit of the bit stream, wherein the active bit indicates that the driver circuitry will drive a second light source of the at least two light sources, wherein the first light source is different than the second light source;

driving the at least two light sources based on the bit stream; and determining a voltage drop across the second light source responsive to reading the active bit.

12. The method of claim 11, wherein the inactive bit is a first inactive bit, the method further comprising:

reading, after reading the inactive bit and based on a value of the inactive bit, a second inactive bit of the bit stream, wherein the inactive bit indicates that the driver circuitry will not drive a third light source of the at least two light sources, wherein the third light source is different than the first light source and the second light source; and reading the active bit after reading the second inactive bit.

13. The method of claim 11, further comprising receiving, after reading the active bit, an update signal indicating that receiving the bit stream is complete, wherein determining the voltage drop across the first light source is further based on receiving the update signal.

14. The method of claim 11, further comprising:

incrementing a counter value in response to receiving each bit of the bit stream until the counter value is a specific value;

determining whether the counter value is a specific value;

reading the inactive bit in response to determining that the counter value is the specific value; and continuing to increment the counter value in response to determining that the counter value is not the specific value.

15. The method of claim 14, further receiving:

determining that a value of the inactive bit is not an active value;

incrementing the counter value in response to determining that the value of the inactive bit is not the active value;

determining that a value of the active bit is an active value; and storing the counter value in response to determining that the value of the active bit is the active value.

16. The method of claim 15, wherein the inactive bit is a first inactive bit, the method further comprising:

reading the second inactive bit in response to determining that the value of the inactive bit is not the active value;

determining that a value of the second inactive bit is not an active value;

incrementing the counter value in response to determining that the value of the second inactive bit is not the active value; and reading the active bit in response to determining that the value of the second inactive bit is not the active value.

17. The method of claim 15, further comprising:

receiving an update signal after reading the active bit, wherein driving the at least two light sources is in response to receiving the update signal; and determining the voltage drop across the first light source is further based on receiving the update signal.

18. The method of claim 17, wherein the bit stream includes a first frame and a second frame, the method further comprising:

receiving the second frame after receiving the update signal;

clearing the counter value in response to the update signal;

incrementing the counter value in response to receiving each bit of the second frame until the counter value is the stored counter value;

determining whether the counter value is the stored counter value;

reading a first bit of the second frame in response to determining that the counter value is the stored counter value, wherein a position of the first bit in the second frame is later than a position of the active bit and later than a position of the inactive bit; and continuing to increment the counter value in response to determining that the counter value is not the specific value.

19. The method of claim 11, further comprising:

determining whether a value of the first bit of the second frame is an active value;

determining a voltage drop across the first light source in response to determining that the value of the first bit of the second frame is the active value;

storing the counter value in response to determining that the value of the first bit of the second frame is the active value;

incrementing the counter value in response to determining that the value of the first bit of the second frame is not the active value; and reading a second bit of the second frame in response to determining that the value of the first bit of the second frame is not the active value.

20. A device comprising:

at least two light sources;

buffer circuitry configured to receive a bit stream;

driver circuitry configured to:

receive the bit stream from the buffer circuitry, wherein each bit of the bit stream indicates whether the driver circuitry will drive a respective light source of the at least two light sources; and drive the at least two light sources based on the bit stream;

monitor circuitry configured to determine a voltage drop across each light source of the at least two light sources;

snooping circuitry configured to:

read an inactive bit of the bit stream, wherein the inactive bit indicates that the driver circuitry will not drive a first light source of the at least two light sources;

read, after reading the inactive bit and based on a value of the inactive bit, an active bit of the bit stream, wherein the active bit indicates that the driver circuitry will drive a second light source of the at least two light sources, wherein the first light source is different than the second light source; and cause the monitor circuitry to determine a voltage drop across the second light source responsive to reading the active bit; and controller circuitry configured to:

determine whether the voltage drop across the second light source is within an acceptable voltage window; and cause the driver circuitry to increase or decrease the voltage drop across the second light source in response to determining whether the voltage drop across the second light source is not within the acceptable voltage window.

* * * * *